US010406046B2

(12) United States Patent
Valentino et al.

(10) Patent No.: US 10,406,046 B2
(45) Date of Patent: Sep. 10, 2019

(54) MANUAL RELEASE SYSTEMS FOR AMBULANCE COTS

(71) Applicant: Ferno-Washington, Inc., Wilmington, OH (US)

(72) Inventors: Nicholas V. Valentino, Springboro, OH (US); Michael Jeffries, Maineville, OH (US); Brian Magill, Morrow, OH (US)

(73) Assignee: Ferno-Washington, Inc., Wilmington, OH (US)

( * ) Notice: Subject to any disclaimer, the term of this patent is extended or adjusted under 35 U.S.C. 154(b) by 0 days.

(21) Appl. No.: 16/163,931

(22) Filed: Oct. 18, 2018

(65) Prior Publication Data

US 2019/0046372 A1 Feb. 14, 2019

Related U.S. Application Data

(63) Continuation of application No. 14/649,240, filed as application No. PCT/US2013/073069 on Dec. 4, 2013, now Pat. No. 10,130,528.

(Continued)

(51) Int. Cl.
*A61G 1/06* (2006.01)
*A61G 1/056* (2006.01)

(Continued)

(52) U.S. Cl.
CPC ..... *A61G 1/0562* (2013.01); *A61G 1/025* (2013.01); *A61G 1/0212* (2013.01);

(Continued)

(58) Field of Classification Search
CPC ..... A61G 1/06

(Continued)

(56) References Cited

U.S. PATENT DOCUMENTS 4,037,871 A 7/1977 Bourgraf et al.
4,236,881 A 12/1980 Pfleger (Continued)

FOREIGN PATENT DOCUMENTS

DE 102009039112 A1 3/2011
GB 2390062 A 12/2003

(Continued)

OTHER PUBLICATIONS

Extended European Search Report dated Jun. 29, 2016 in reference to co-pending European Patent Application No. 13860140.6.
International Search Report and Written Opinion pertaining to Application No. PCT/US2013/073069 filed Dec. 4, 2013.

*Primary Examiner* — Fredrick C Conley
(74) *Attorney, Agent, or Firm* — Dinsmore & Shohl, LLP

(57) ABSTRACT

Embodiments of a cot comprise a support frame, legs coupled to the support frame, at least one hydraulic actuator configured to raise or lower the legs, and a manual release system coupled to the at least one actuator and configured to lower the cot manually at a controlled descent rate. The manual release system comprises a manual actuation component, a manual release valve operable to be opened upon actuation by the manual actuation component, a fluid reservoir operable to receive hydraulic fluid from the at least one actuator upon opening of the manual valve; and a flow regulator configured to control the flow rate of the hydraulic fluid into the fluid reservoir, wherein the release of hydraulic fluid into the fluid reservoir at the controlled flow rate is configured to manually lower the cot at the controlled descent rate.

16 Claims, 12 Drawing Sheets

Related U.S. Application Data

(60) Provisional application No. 61/733,060, filed on Dec. 4, 2012.

(51) Int. Cl.
*A61G 1/02* (2006.01)
*A61G 7/05* (2006.01)
*A61G 7/012* (2006.01)
*A61G 7/018* (2006.01)

(52) U.S. Cl.
CPC ..... *A61G 1/0567* (2013.01); *A61G 7/0527* (2016.11); *A61G 1/0237* (2013.01); *A61G 1/0256* (2013.01); *A61G 1/0262* (2013.01); *A61G 7/012* (2013.01); *A61G 7/018* (2013.01); *A61G 2203/726* (2013.01)

(58) Field of Classification Search
USPC ..... 5/611, 625–627
See application file for complete search history.

(56) References Cited

U.S. PATENT DOCUMENTS

| | | | | |
|---|---|---|---|---|
| 4,921,295 | A | 5/1990 | Stollenwerk | |
| 2004/0088792 | A1* | 5/2004 | O'Krangley | A61G 1/0562 5/611 |
| 2006/0075558 | A1 | 4/2006 | Lambarth et al. | |
| 2006/0225203 | A1 | 10/2006 | Hosoya et al. | |
| 2009/0165208 | A1* | 7/2009 | Reed | A61G 1/052 5/611 |
| 2009/0222988 | A1* | 9/2009 | Reed | A61G 1/0567 5/627 |
| 2011/0067179 | A1 | 3/2011 | Klemm et al. | |

FOREIGN PATENT DOCUMENTS

| | | | |
|---|---|---|---|
| WO | 0170161 | A1 | 9/2001 |
| WO | 2011088169 | A1 | 7/2011 |

* cited by examiner

MANUAL RELEASE SYSTEMS FOR AMBULANCE COTS

CROSS-REFERENCE TO RELATED APPLICATIONS

This application claims priority to U.S. patent application Ser. No. 14/649,240 filed Jun. 3, 2015, which claims priority to PCT/US2013/073069 filed Dec. 4, 2013, which claims priority to U.S. provisional application 61/733,060 filed Dec. 4, 2012, which is incorporated by reference herein in its entirety.

TECHNICAL FIELD

The present disclosure is generally related to manual release components, and is specifically directed to manual release components for hydraulically powered ambulance cots.

BACKGROUND

There are a variety of emergency cots in use today. Such emergency cots may be designed to transport and load bariatric patients into an ambulance.

For example, the PROFlexX® cot, by Ferno-Washington, Inc. of Wilmington, Ohio U.S.A., is a manually actuated cot that may provide stability and support for loads of about 700 pounds (about 317.5 kg). The PROFlexX® cot includes a patient support portion that is attached to a wheeled undercarriage. The wheeled under carriage includes an X-frame geometry that can be transitioned between nine selectable positions. One recognized advantage of such a cot design is that the X-frame provides minimal flex and a low center of gravity at all of the selectable positions. Another recognized advantage of such a cot design is that the selectable positions may provide better leverage for manually lifting and loading bariatric patients.

Another example of a cot designed for bariatric patients, is the POWERFlexx+ Powered Cot, by Ferno-Washington, Inc. The POWERFlexx+ Powered Cot includes a battery powered actuator that may provide sufficient power to lift loads of about 700 pounds (about 317.5 kg). One recognized advantage of such a cot design is that the cot may lift a bariatric patient up from a low position to a higher position, i.e., an operator may have reduced situations that require lifting the patient.

A further variety is a multipurpose roll-in emergency cot having a patient support stretcher that is removably attached to a wheeled undercarriage or transporter. The patient support stretcher when removed for separate use from the transporter may be shuttled around horizontally upon an included set of wheels. One recognized advantage of such a cot design is that the stretcher may be separately rolled into an emergency vehicle such as station wagons, vans, modular ambulances, aircrafts, or helicopters, where space and reducing weight is a premium.

Another advantage of such a cot design is that the separated stretcher may be more easily carried over uneven terrain and out of locations where it is impractical to use a complete cot to transfer a patient. Example of such cots can be found in U.S. Pat. Nos. 4,037,871, 4,921,295, and International Publication No. WO0170161.

Although the foregoing multipurpose roll-in emergency cots have been generally adequate for their intended purposes, they have not been satisfactory in all aspects. For example, the foregoing emergency cots are loaded into ambulances according to loading processes that require at least one operator to support the load of the cot for a portion of the respective loading process.

SUMMARY

According to one embodiment, a cot is provided, wherein the cot comprises a support frame, legs coupled to the support frame, at least one hydraulic actuator configured to raise or lower the legs, and a manual release system coupled to the at least one actuator and configured to lower the cot manually at a controlled descent rate. The manual release system comprises a manual actuation component, a manual release valve operable to be opened upon actuation by the manual actuation component, a fluid reservoir operable to receive hydraulic fluid from the at least one actuator upon opening of the manual release valve, and a flow regulator configured to control a flow rate of the hydraulic fluid into the fluid reservoir, wherein the release of hydraulic fluid into the fluid reservoir at the controlled flow rate is configured to manually lower the cot at a controlled descent rate.

These and additional features provided by the embodiments of the present disclosure will be more fully understood in view of the following detailed description, in conjunction with the drawings.

BRIEF DESCRIPTION OF THE DRAWINGS

The following detailed description of specific embodiments of the present disclosures can be best understood when read in conjunction with the following drawings, where like structure is indicated with like reference numerals and in which.

Figure 1:
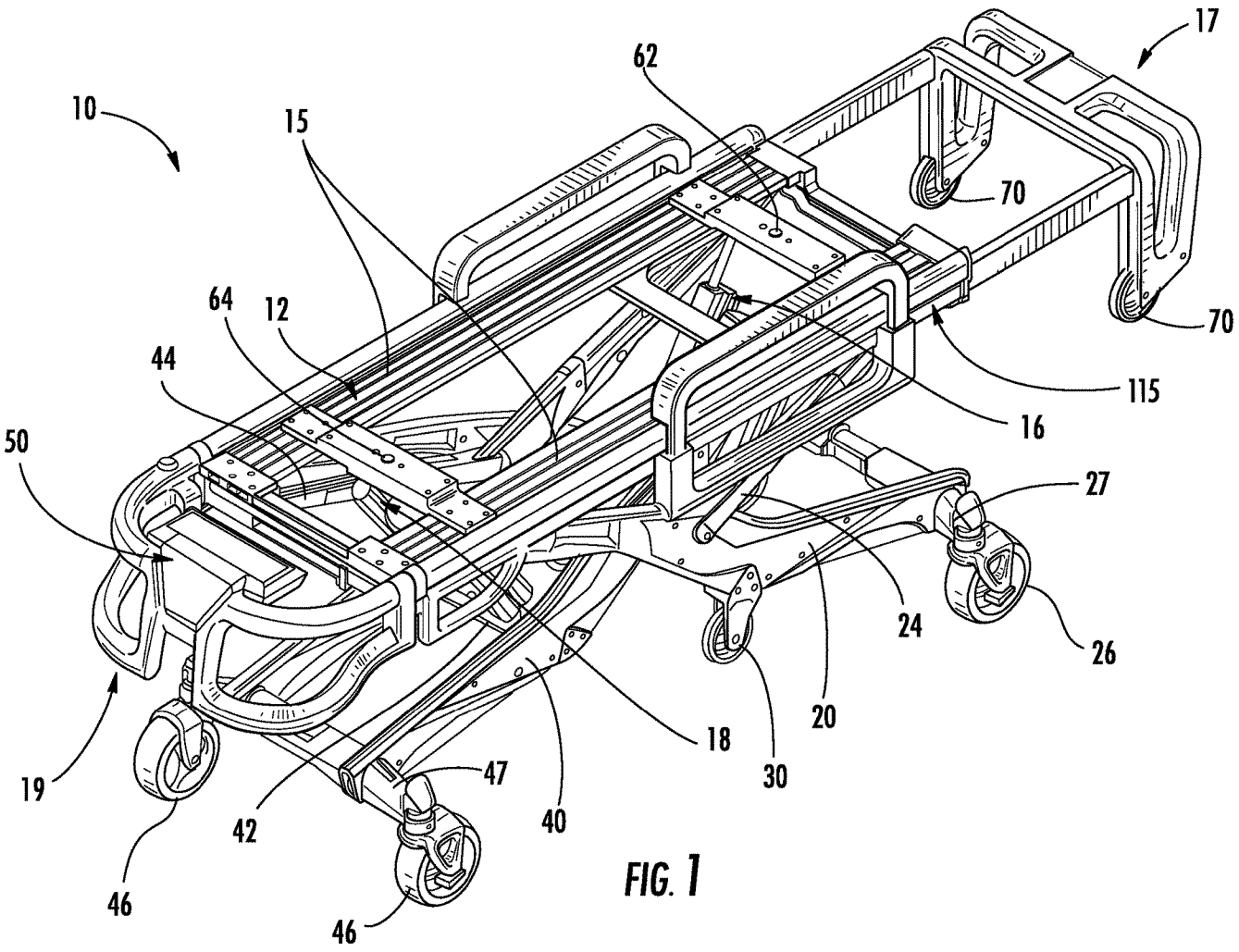
FIG. 1 is a perspective view depicting a cot according to one or more embodiments described herein.

The embodiments set forth in the drawings are illustrative in nature and not intended to be limiting of the embodiments described herein. Moreover, individual features of the drawings and embodiments will be more fully apparent and understood in view of the detailed description.

DETAILED DESCRIPTION

Referring to FIG. 1, a roll-in cot 10 for transport and loading is shown. The roll-in cot 10 comprises a support frame 12 comprising a front end 17, and a back end 19. As used herein, the front end 17 is synonymous with the loading end, i.e., the end of the roll-in cot 10 which is loaded first onto a loading surface. Conversely, as used herein, the back end 19 is the end of the roll-in cot 10 which is loaded last onto a loading surface. Additionally it is noted, that when the roll-in cot 10 is loaded with a patient, the head of the patient may be oriented nearest to the front end 17 and the feet of the patient may be oriented nearest to the back end 19. Thus, the phrase "head end" may be used interchangeably with the phrase "front end," and the phrase "foot end" may be used interchangeably with the phrase "back end." Furthermore, it is noted that the phrases "front end" and "back end" are interchangeable. Thus, while the phrases are used consistently throughout for clarity, the embodiments described herein may be reversed without departing from the scope of the present disclosure. Generally, as used herein, the term "patient" refers to any living thing or formerly living thing such as, for example, a human, an animal, a corpse and the like.

Figure 2:
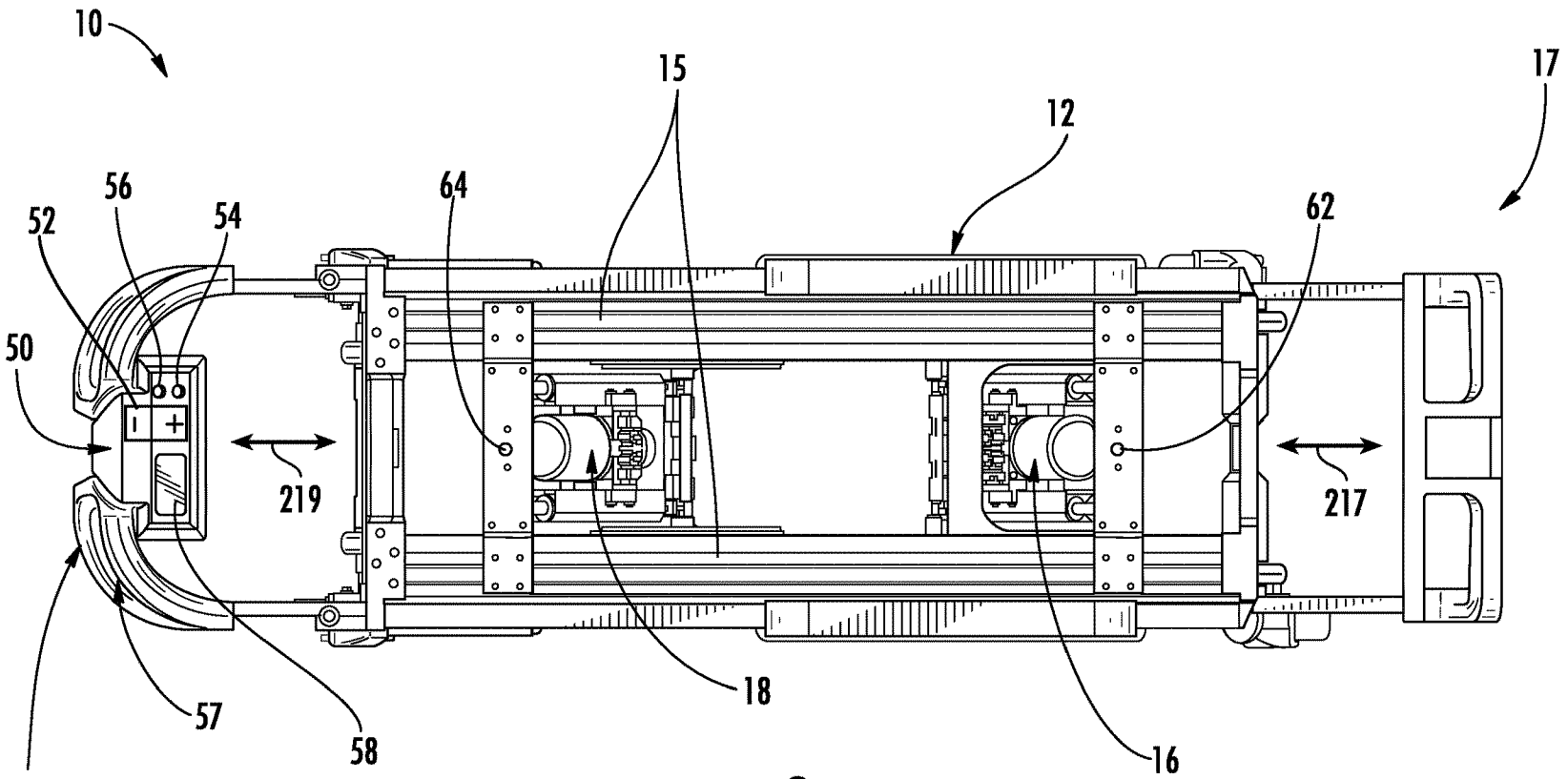
FIG. 2 is a top view depicting a cot according to one or more embodiments described herein.

Referring to FIG. 2, the front end 17 and/or the back end 19 may be telescoping. In one embodiment, the front end 17 may be extended and/or retracted (generally indicated in FIG. 2 by arrow 217). In another embodiment, the back end 19 may be extended and/or retracted (generally indicated in FIG. 2 by arrow 219). Thus, the total length between the front end 17 and the back end 19 may be increased and/or decreased to accommodate various sized patients.

Referring collectively to FIGS. 1 and 2, the support frame 12 may comprise a pair of substantially parallel lateral side members 15 extending between the front end 17 and the back end 19. Various structures for the lateral side members 15 are contemplated. In one embodiment, the lateral side members 15 may be a pair of spaced metal tracks. In another embodiment, the lateral side members 15 comprise an undercut portion 115 that is engageable with an accessory clamp (not depicted). Such accessory clamps may be utilized to removably couple patient care accessories such as a pole for an IV drip to the undercut portion 115. The undercut portion 115 may by provided along the entire length of the lateral side members to allow accessories to be removably clamped to many different locations on the roll-in cot 10.

Referring again to FIG. 1, the roll-in cot 10 also comprises a pair of retractable and extendible front legs 20 coupled to the support frame 12, and a pair of retractable and extendible back legs 40 coupled to the support frame 12. The roll-in cot 10 may comprise any rigid material such as, for example, metal structures or composite structures. Specifically, the support frame 12, the front legs 20, the back legs 40, or combinations thereof may comprise a carbon fiber and resin structure. As is described in greater detail herein, the roll-in cot 10 may be raised to multiple heights by extending the front legs 20 and/or the back legs 40, or the roll-in cot 10 may be lowered to multiple heights by retracting the front legs 20 and/or the back legs 40. It is noted that terms such as "raise," "lower," "above," "below," and "height" are used herein to indicate the distance relationship between objects measured along a line parallel to gravity using a reference (e.g. a surface supporting the cot).

In specific embodiments, the front legs 20 and the back legs 40 may each be coupled to the lateral side members 15. As shown in FIGS. 3A-4E, the front legs 20 and the back legs 40 may cross each other, when viewing the cot from a side, specifically at respective locations where the front legs 20 and the back legs 40 are coupled to the support frame 12 (e.g., the lateral side members 15 (FIGS. 1-2)). As shown in the embodiment of FIG. 1, the back legs 40 may be disposed inwardly of the front legs 20, i.e., the front legs 20 may be spaced further apart from one another than the back legs 40 are spaced from one another such that the back legs 40 are each located between the front legs 20. Additionally, the front legs 20 and the back legs 40 may comprise front wheels 26 and back wheels 46 which enable the roll-in cot 10 to roll.

In one embodiment, the front wheels 26 and back wheels 46 may be swivel caster wheels or swivel locked wheels. As the roll-in cot 10 is raised and/or lowered, the front wheels 26 and back wheels 46 may be synchronized to ensure that the plane of the lateral side members 15 of the roll-in cot 10 and the plane of the wheels 26, 46 are substantially parallel.

Referring again to FIG. 1, the roll-in cot 10 may also comprise a cot actuation system comprising a front actuator 16 configured to move the front legs 20 and a back actuator 18 configured to move the back legs 40. The cot actuation system may comprise one unit (e.g., a centralized motor and pump) configured to control both the front actuator 16 and the back actuator 18. For example, the cot actuation system may comprise one housing with one motor capable to drive the front actuator 16, the back actuator 18, or both utilizing valves, control logic and the like. Alternatively, as depicted in FIG. 1, the cot actuation system may comprise separate units configured to control the front actuator 16 and the back actuator 18 individually. In this embodiment, the front actuator 16 and the back actuator 18 may each include separate housings with individual motors to drive each of the front actuator 16 and the back actuator 18.

Referring to FIG. 1, the front actuator 16 is coupled to the support frame 12 and configured to actuate the front legs 20 and raise and/or lower the front end 17 of the roll-in cot 10. Additionally, the back actuator 18 is coupled to the support frame 12 and configured to actuate the back legs 40 and raise and/or lower the back end 19 of the roll-in cot 10. The roll-in cot 10 may be powered by any suitable power source. For example, the roll-in cot 10 may comprise a battery capable of supplying a voltage of, such as, about 24 V nominal or about 32 V nominal for its power source.

The front actuator 16 and the back actuator 18 are operable to actuate the front legs 20 and back legs 40, simultaneously or independently. As shown in FIGS. 3A-4E, simultaneous and/or independent actuation allows the roll-in cot 10 to be set to various heights. The actuators described herein may be capable of providing a dynamic force of about 350 pounds (about 158.8 kg) and a static force of about 500 pounds (about 226.8 kg). Furthermore, the front actuator 16 and the back actuator 18 may be operated by a centralized motor system or multiple independent motor systems.

Figure 5:
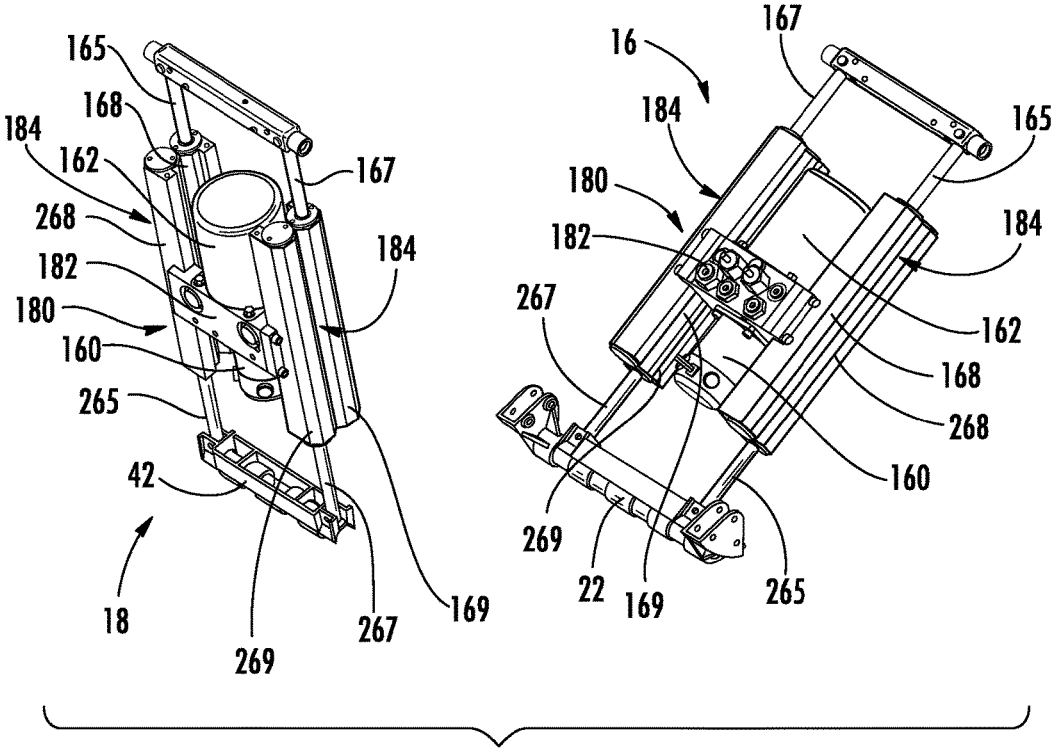
FIG. 5 schematically depicts an actuator system of a cot according to one or more embodiments described herein.

In one embodiment, schematically depicted in FIGS. 1-2 and 5, the front actuator 16 and the back actuator 18 comprise hydraulic actuators for actuating the roll-in cot 10. In the embodiment depicted in FIG. 6, the front actuator 16 and the back actuator 18 are dual piggy back hydraulic actuators, i.e., the front actuator 16 and the back actuator 18 each forms a master-slave hydraulic circuit 300. The master-slave hydraulic circuit 300 comprises four hydraulic cylinders with four extending rods that are piggy backed (i.e., mechanically coupled) to one another in pairs. Thus, the dual piggy back actuator comprises a first hydraulic cylinder with a first rod, a second hydraulic cylinder with a second rod, a third hydraulic cylinder with a third rod and a fourth hydraulic cylinder with a fourth rod. It is noted that, while the embodiments described herein make frequent reference to a master-slave system comprising four hydraulic cylinders, the master-salve hydraulic circuits described herein can include any even number of hydraulic cylinders.

Referring collectively to FIG. 5, the front actuator 16 and the back actuator 18 comprises a rigid support frame 180 that is substantially "H" shaped (i.e., two vertical portions connected by a cross portion). The rigid support frame 180 comprises a cross member 182 that is coupled to two vertical members 184 at about the middle of each of the two vertical members 184. A pump motor 160 and a fluid reservoir 162 are coupled to the cross member 182 and in fluid communication. In one embodiment, the pump motor 160 and the fluid reservoir 162 are disposed on opposite sides of the cross member 182 (e.g., the fluid reservoir 162 disposed above the pump motor 160). Specifically, the pump motor 160 may be a brushed bi-rotational electric motor with a peak output of about 1400 watts. The rigid support frame 180 may include additional cross members or a backing plate to provide further rigidity and resist twisting or lateral motion of the vertical members 184 with respect to the cross member 182 during actuation.

Each vertical member 184 comprises a pair of piggy backed hydraulic cylinders (i.e., a first hydraulic cylinder and a second hydraulic cylinder or a third hydraulic cylinder and a fourth hydraulic cylinder) wherein the first cylinder extends a rod in a first direction and the second cylinder extends a rod in a substantially opposite direction. When the cylinders are arranged in one master-slave configuration, one of the vertical members 184 comprises an upper master cylinder 168 and a lower master cylinder 268. The other of the vertical members 184 comprises an upper slave cylinder 169 and a lower slave cylinder 269. It is noted that, while master cylinders 168, 268 are piggy backed together and extend rods 165, 265 in substantially opposite directions, master cylinders 168, 268 may be located in alternate vertical members 184 and/or extend rods 165, 265 in substantially the same direction.

Figure 6:
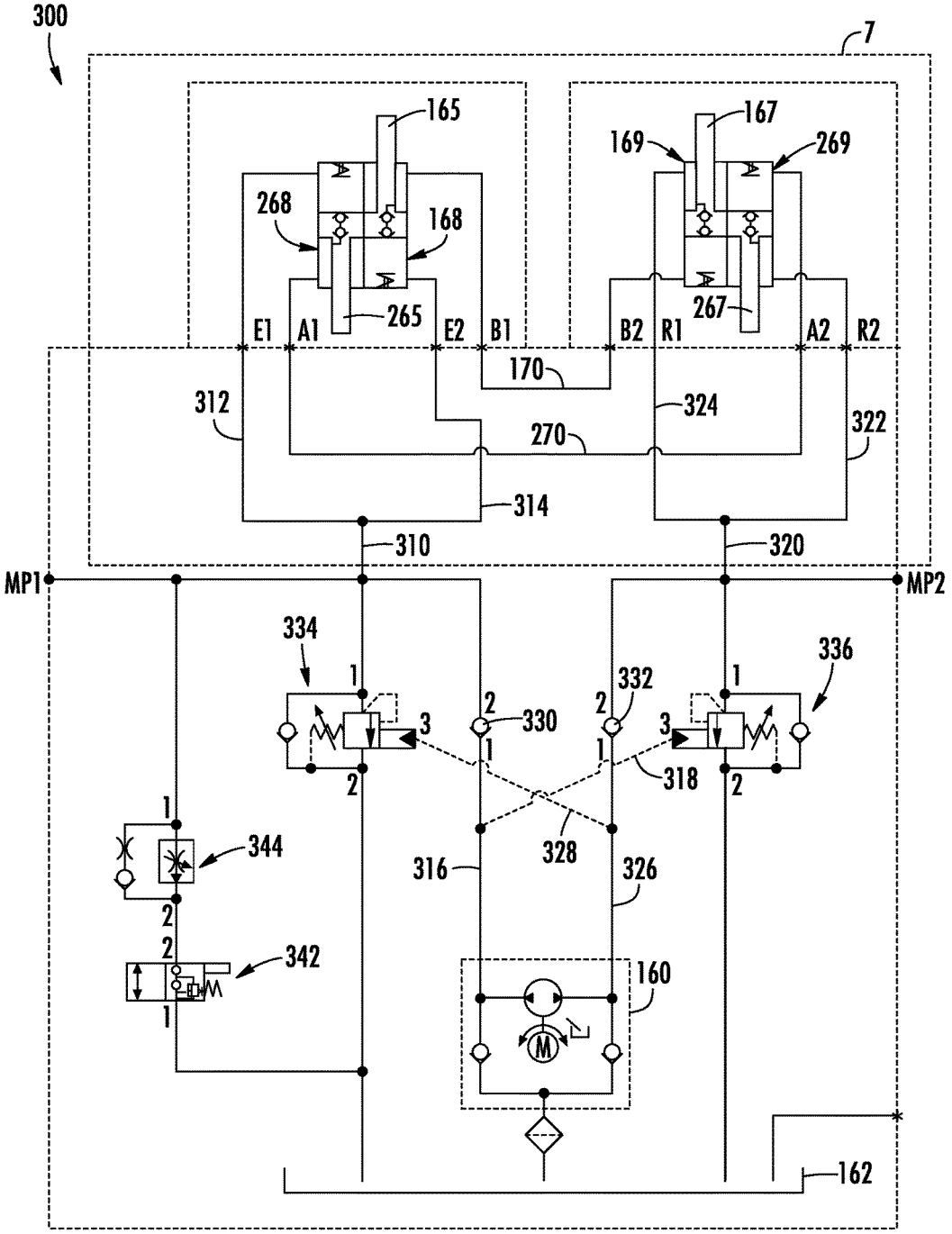
FIG. 6 schematically depicts a master-salve hydraulic circuit according to one or more embodiments described herein.

Referring now to FIG. 6, the master-slave hydraulic circuit 300 can be formed by placing multiple cylinders in fluidic communication with each other. In one embodiment, an upper master cylinder 168 is in fluidic communication with an upper slave cylinder 169 and may communicate hydraulic fluid via a fluid connection 170. A lower master cylinder 268 is in fluidic communication with a lower slave cylinder 269 and may communicate hydraulic fluid via a fluid connection 270.

The upper master cylinder 168 is in fluidic communication with a fluid connection 312, which is in fluidic communication with a fluid connection 310. Similarly, the lower master cylinder 268 is in fluidic communication with a fluid connection 312, which is in fluidic communication with the fluid connection 310. When the upper master rod 165, the lower master rod 265, the upper slave rod 167 and the lower slave rod 267 are extended, hydraulic fluid can be supplied from the pump motor 160 via the fluid connection 310. Specifically, the pump motor 160 can be in fluidic communication with a fluid connection 316. A check valve 330 can be in fluidic communication with both the fluid connection 310 and the fluid connection 316 such that hydraulic fluid can be supplied from the fluid connection 316 to the fluid connection 310, but hydraulic fluid is prevented from being supplied to the fluid connection 316 from the fluid connection 310. When the pump motor 160 is actuated in a first direction, hydraulic fluid can be delivered from the fluid reservoir 162 to the upper master cylinder 168 and the lower master cylinder 268.

The upper slave cylinder 169 is in fluidic communication with a fluid connection 324, which is in fluidic communication with a fluid connection 320. Similarly, the lower slave cylinder 269 is in fluidic communication with a fluid connection 322, which is in fluidic communication with the fluid connection 320. When the upper master rod 165, the lower master rod 265, the upper slave rod 167 and the lower slave rod 267 are extended, hydraulic fluid can be supplied from the fluid connection 320 to the fluid reservoir 162.

In one embodiment, a counterbalance valve 336 can be in fluidic communication with both the fluid connection 320 and the fluid reservoir 162. A pilot line 318 can be in fluidic communication with both the fluid connection 316 and the counterbalance valve 336. The counterbalance valve 336 can allow hydraulic fluid to flow from the fluid reservoir 162 to the fluid connection 320, and prevent hydraulic fluid from flowing from the fluid connection 320 to the fluid reservoir 162, unless an appropriate pressure is received via the pilot line 318. When the pump motor 160 pumps hydraulic fluid through fluid connection 316, the pilot line 318 can cause the counterbalance valve 336 to modulate and allow hydraulic fluid to flow from the fluid connection 320 to the fluid reservoir 162. Accordingly, when the pump motor 160 is actuated in a first direction, hydraulic fluid can be delivered from the upper slave cylinder 169 and the lower slave cylinder 269 to the fluid reservoir 162.

When the upper master rod 165, the lower master rod 265, the upper slave rod 167 and the lower slave rod 267 are retracted, hydraulic fluid can be supplied from the pump motor 160 via the fluid connection 320. Specifically, the pump motor 160 can be in fluidic communication with a fluid connection 326. A check valve 332 can be in fluidic communication with both the fluid connection 320 and the fluid connection 326 such that hydraulic fluid can be supplied from the fluid connection 326 to the fluid connection 320, but hydraulic fluid is prevented from being supplied to the fluid connection 320 from the fluid connection 326.

Accordingly, when the pump motor 160 is actuated in a second direction, hydraulic fluid can be delivered from the fluid reservoir 162 to the upper slave cylinder 169 and the lower slave cylinder 269. Also, hydraulic fluid can be delivered from the upper master cylinder 168 and the lower master cylinder 268 to the fluid reservoir 162. Specifically, a counterbalance valve 334 can be in fluidic communication with both the fluid connection 310 and the fluid reservoir 162. A pilot line 328 can be in fluidic communication with both the fluid connection 326 and the counterbalance valve 334. The counterbalance valve 334 can allow hydraulic fluid to flow from the fluid reservoir 162 to the fluid connection 310, and prevent hydraulic fluid from flowing from the fluid connection 310 to the fluid reservoir 162, unless an appropriate pressure is received via the pilot line 328. When the pump motor 160 pumps hydraulic fluid through fluid connection 326, the pilot line 328 can cause the counterbalance valve 334 to modulate and allow hydraulic fluid to flow from the fluid connection 310 to the fluid reservoir 162. Accordingly, when the pump motor 160 is actuated in the second direction, hydraulic fluid can be delivered from the upper master cylinder 168 and the lower master cylinder 268 to the fluid reservoir 162.

While the cot actuation system is typically powered, the cot actuation system may also comprise a manual release system coupled to the at least one actuator and configured to lower the cot manually at a controlled descent rate. The manual release system comprises a manual actuation component 355 (e.g., a button, handle, knob, tension member, switch, linkage or lever) that actuates a manual release valve to allow an operator to lower at least one actuator (e.g., the front actuator 16, the back actuator 18, or both) manually.

Figure 9:
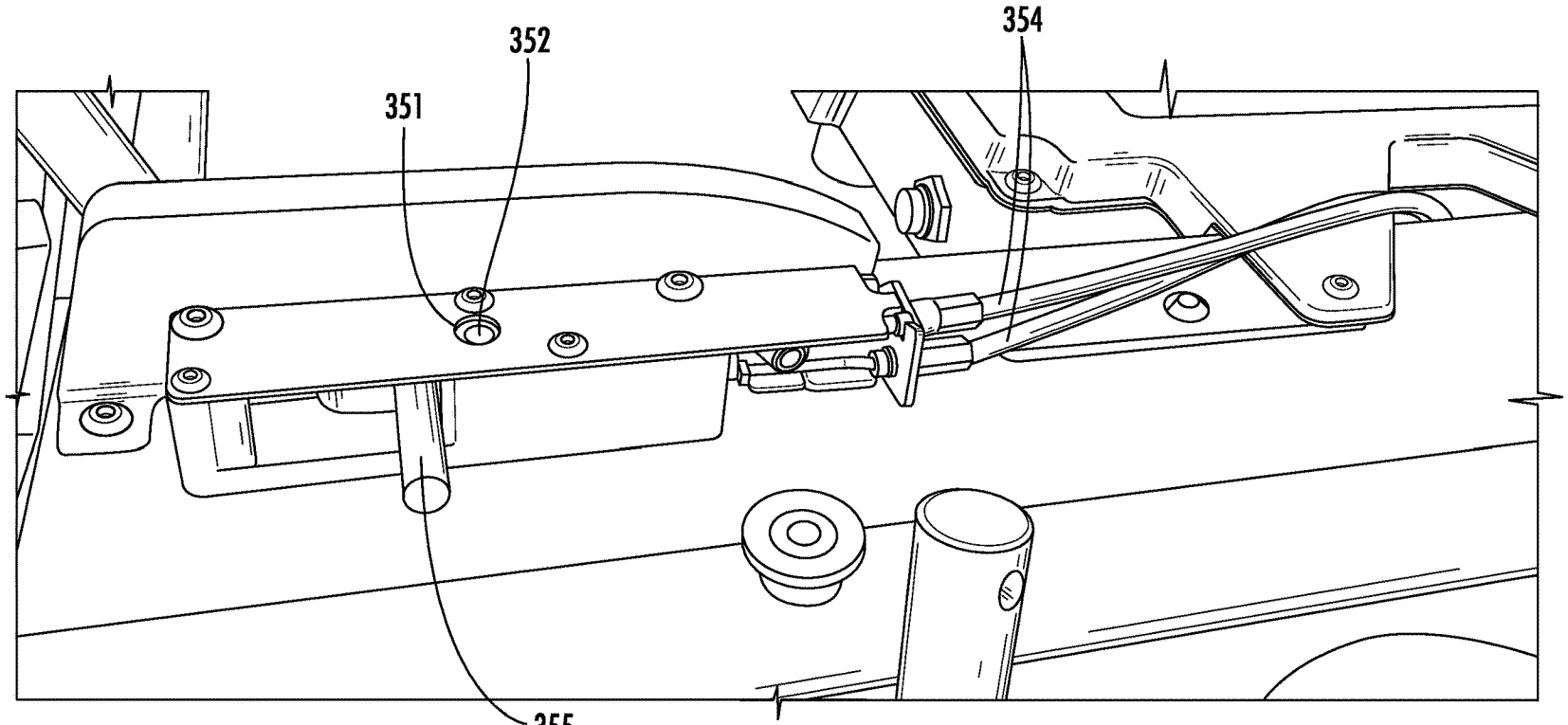
FIG. 9 depicts the manual release component according to one or more embodiments described herein.
Figure 10:
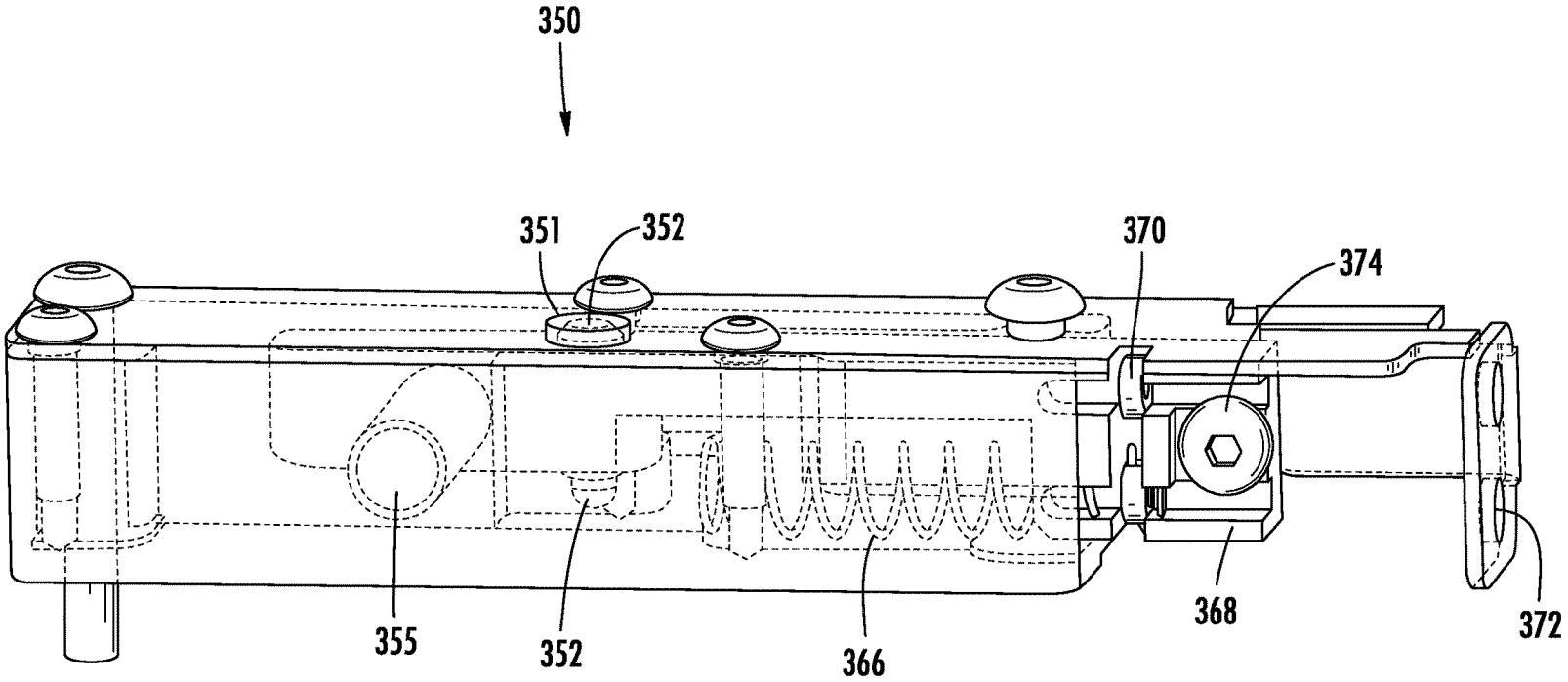
FIG. 10 depicts in phantom the manual release according to one or more embodiments described herein.
Figure 11:
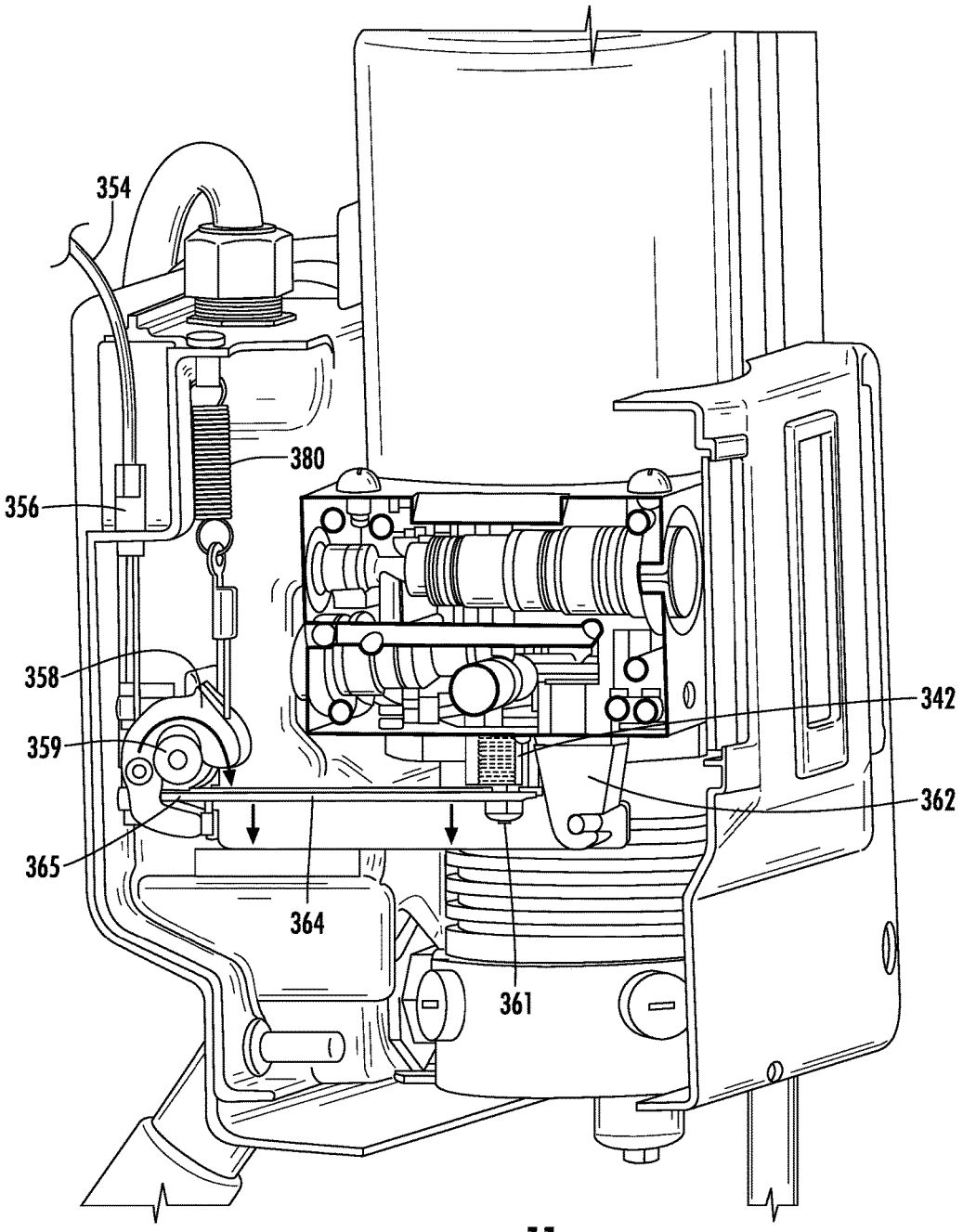
FIG. 11 depicts the components of a manual release on the underside of an actuator according to one or more embodiments described herein.

Referring to FIGS. 9-11, the manual actuation component 355 actuates a manual release valve 342 that is normally closed to an open position. As shown in FIG. 6, the manual valve 342 can be in fluidic communication with the fluid reservoir 162 and a flow regulator 344. The flow regulator 344 can also be in fluidic communication with the fluid connection 310. Thus, when a load is applied to the roll-in cot 10 and the manual valve 342 is opened, hydraulic fluid can be delivered from the upper master cylinder 168 and the lower master cylinder 268 through the flow regulator 344 to the fluid reservoir 162. Accordingly, the flow regulator 344, which may be triggered by the application of a load force, can be utilized to provide a controlled descent of the roll-in cot 10. Without being bound by theory, the flow regulator controls the flow rate of the hydraulic fluid into the fluid reservoir such that the at least one actuator has sufficient fluid to at least partially counter the load force and thereby facilitates the gradual controlled descent of the cot. Without the flow regulator, it is contemplated that hydraulic fluid would flood out of the hydraulic actuators and into the fluid reservoir upon the application of a load force, thereby causing rapid compression of the actuators, rapid retraction of the legs, and thus a rapid descent by the cot. As would be understood, a rapid descent would be undesirable for an ambulance cot supporting a patient, thus controlling the flow rate of hydraulic fluid out of the actuators via the flow regulator is beneficial in that it facilitates the manual lowering of a cot at a controlled descent rate. In short, the controlled flow rate of the hydraulic fluid is related to the controlled descent rate of the cot.

The manual release component may be disposed at various positions on the roll-in cot 10, for example, on the back end 19 or on the side of the roll-in cot 10. It is noted that, while the flow regulator 344 and the manual valve 342 are depicted in a particular arrangement, the manual valve 342 can be located between the flow regulator 344 and the fluid connection 310.

Referring to the embodiment of FIG. 11, the manual release valve 342 may be disposed adjacent to the front actuator 16, the back actuator, or both. For example in FIG. 11, the manual release valve 342 may be disposed on the underside of the front actuator 16. Various additional positions are also contemplated for the manual release valve, and it is contemplated that the manual release valve 342 may be opened via various components and mechanisms. In one such mechanism, the manual release valve 342 may be opened via manual release component that us held by the operator while the cot is in manual mode.

Various embodiments are contemplated for the manual actuation component. For example, the manual actuation component may be a bicycle handlebar. Alternatively, as shown in the embodiment of FIG. 10, the manual actuation component may be a slidable knob 355 which is coupled to a spring plunger 352. To move the slidable knob 355, the slidable knob 355 must be pushed downward to overcome the spring tension of the spring plunger 352, thereby disengaging the upper edge of the spring plunger 352 from being seated inside a locking slot 351. Additionally as shown in FIG. 10, the slidable knob 355 is coupled to a return spring 366, which is coupled to one or more cables 354 as shown in FIG. 11. To maintain the positioning of the cables 354, the manual release 350 may comprise cable jacket mounting members 372, and may be positioned in bracket slots 368. Additionally, a fastener such as a nut 374 may be used to ensure that the cables 354 are positioned in bracket slots 368.

Referring to FIGS. 9 and 11, sliding the knob 355 pulls cable 354 and cable connector 356. When the cable 354 is pulled, a rotating cam member 358, which is attached to the cable 354, rotates about a central wheel 359 to trigger the movement of lever 364. As shown in FIG. 11, the lever 364 includes a lip 365 at one end, which may be positioned underneath central wheel 359 of the cam member 358, and includes a lever hinge 362 at the opposite end. Between the lip 365 and lever hinge 362, the lever 364 is coupled to the manual valve 342 via a bolt 361. Other fasteners in addition to the bolt are also contemplated herein. As shown, the manual valve 342 may be spring biased. In operation, the rotation of the cam member 358 pushes the lever 364 downward, which thereby overcomes the spring tension of the manual valve 342 to open the manual valve 342.

As stated above, the cot actuation system may include various components which ensure that the manual release valve 342 is not opened unless the user is actuating the manual release component e.g., sliding knob 355. In essence, the cot actuation system will reset to its powered operation mode, when the user releases the manual release component 350. As shown in FIG. 10, the return spring 366 will close the manual release valve 342 if the user does not continually hold the sliding knob 355. Further as shown in FIG. 11, the cot actuation system may comprise another return spring 380 which will reset the position of the rotating cam member 358. Additionally, the manual valve 342 may include a spring that resets the valve to the closed position when the user is not holding the manual release component, e.g., the sliding knob 355.

Figure 7A:
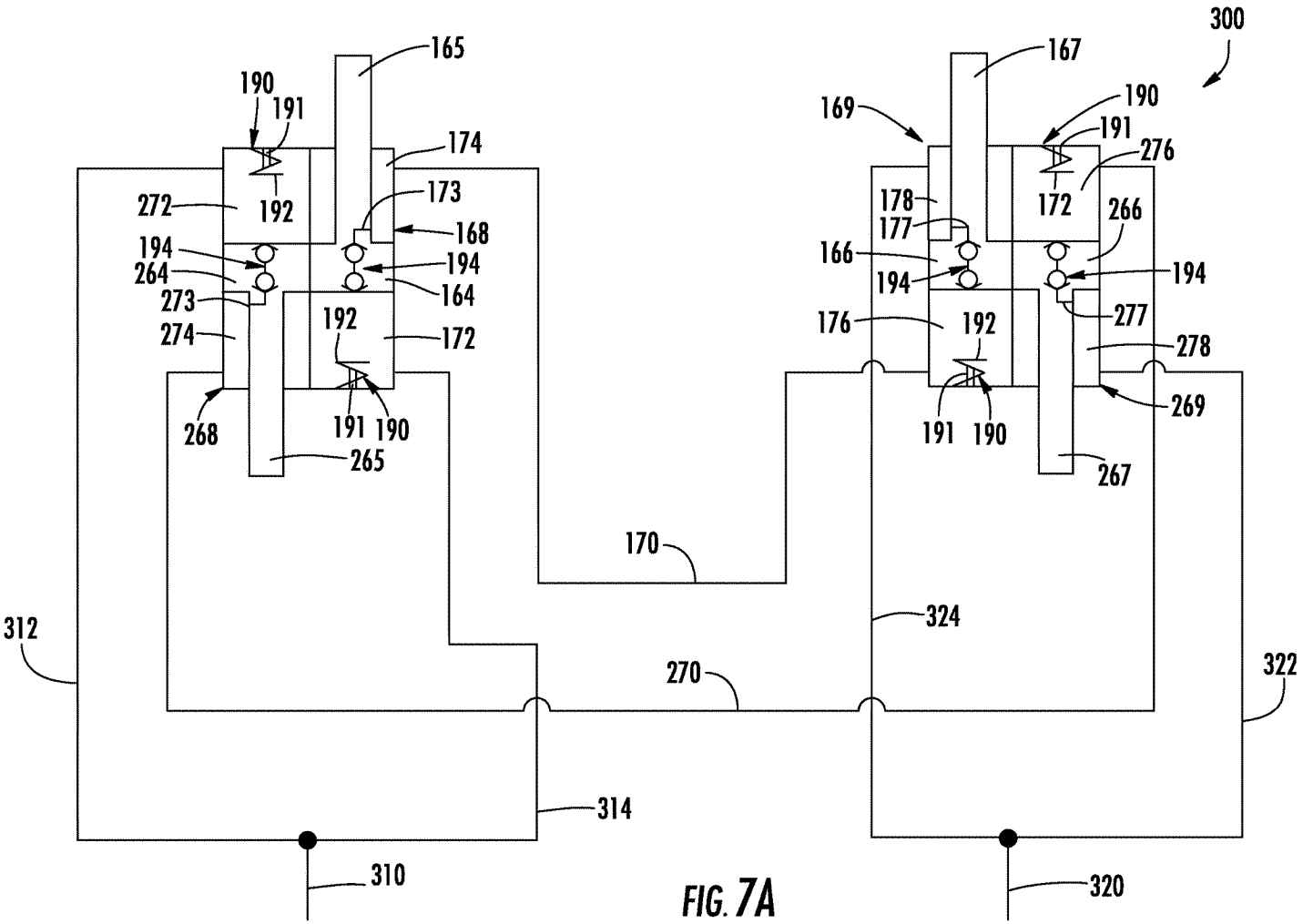
FIGS. 7A and 7B schematically depict a master-salve hydraulic circuit according to one or more embodiments described herein.
Figure 7B:
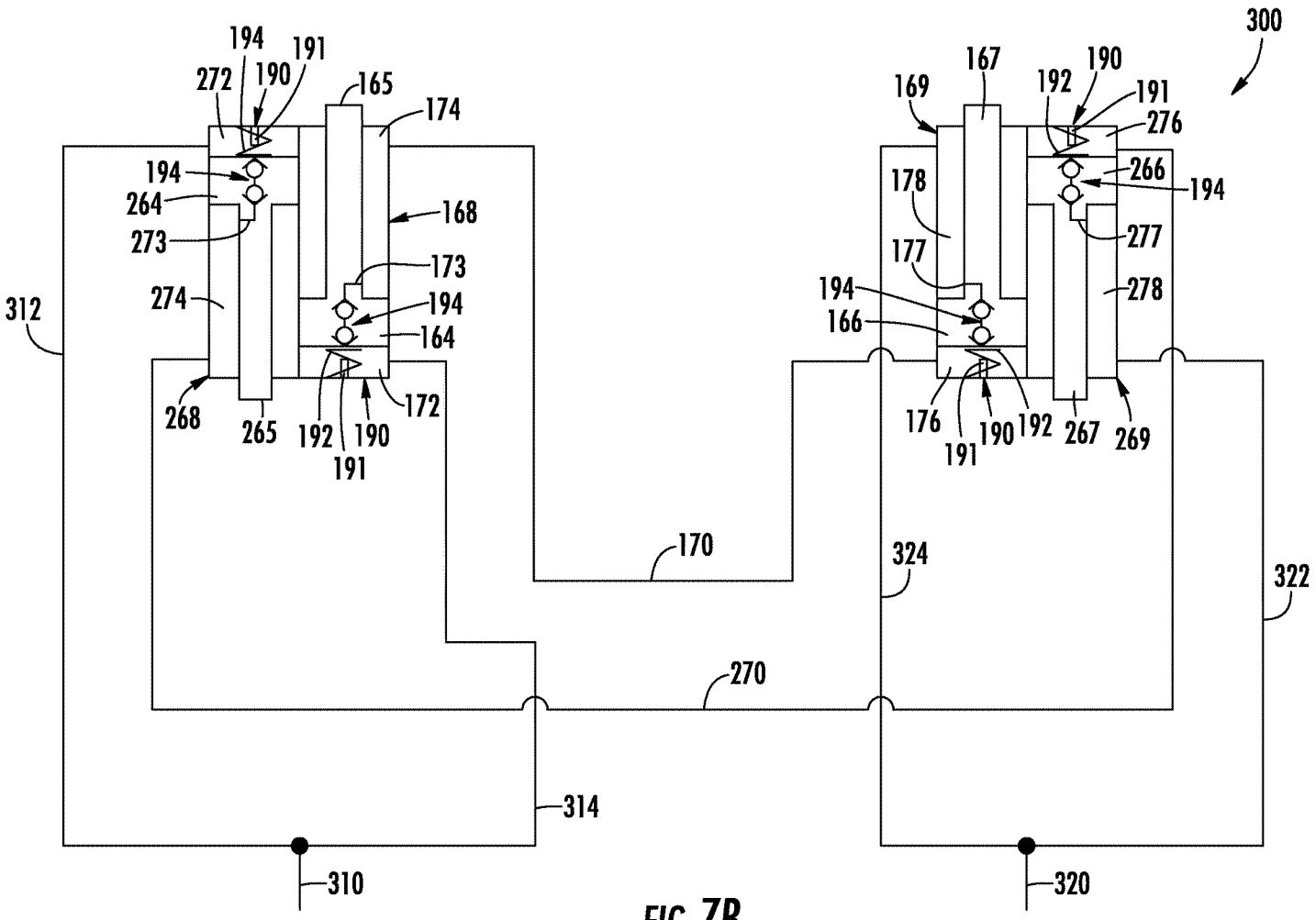
Figure 8:
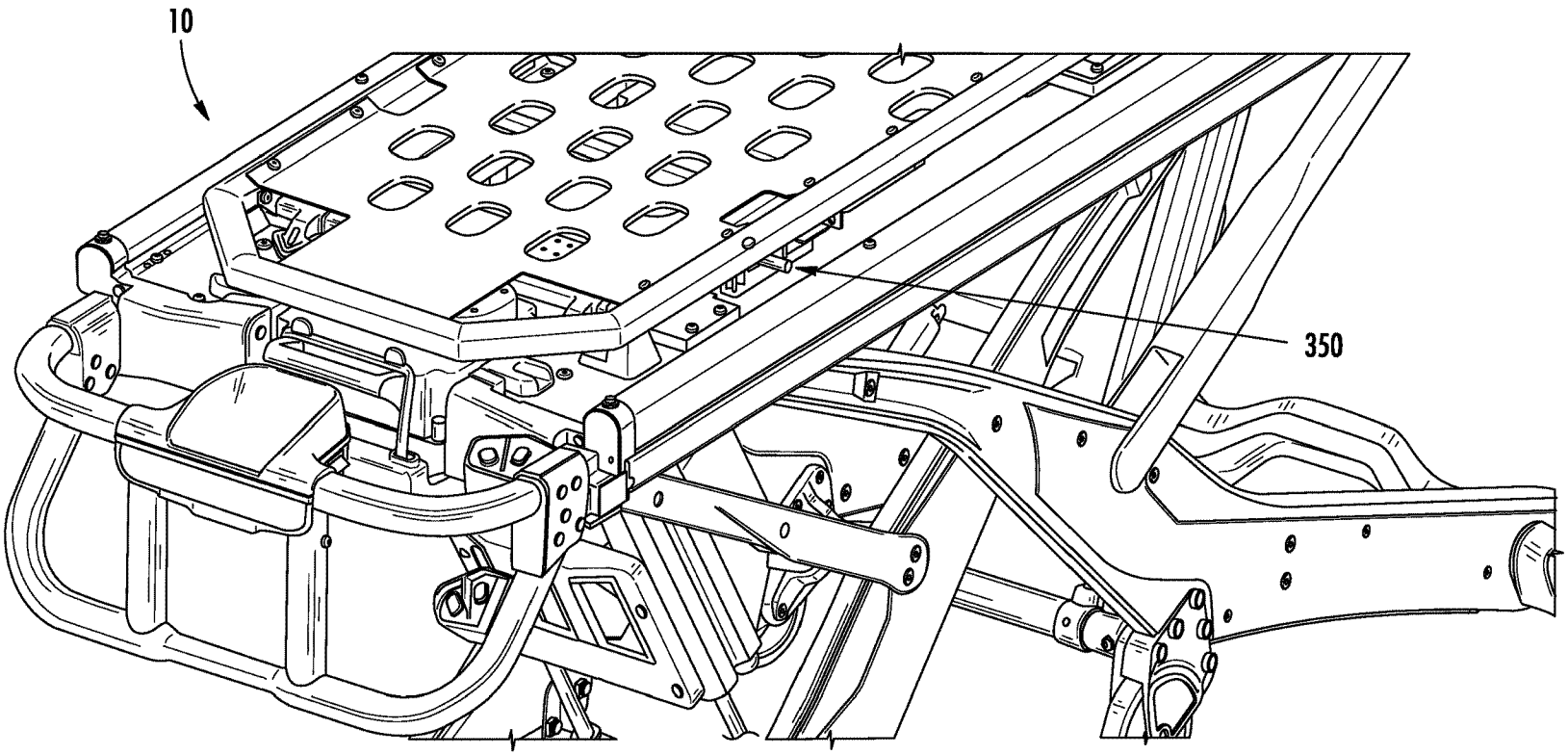
FIG. 8 depicts the position of a manual release component according to one or more embodiments described herein.

Referring collectively to FIGS. 6, 7A, and 7B, in one embodiment of the master-slave hydraulic circuit 300, each of the upper master cylinder 168, the upper slave cylinder 169, the lower master cylinder 268 and the lower slave cylinder 269 can be split into multiple volumes. Specifically, the upper master cylinder 168 can comprise a first master volume 172 that is fluidically separated from a second master volume 174 by the upper master piston 164 and the upper master rod 165. The upper slave cylinder 169 can comprise a first slave volume 176 that is fluidically separated from a second slave volume 178 by the upper slave piston 166 and the upper slave rod 167. In the depicted embodiment, the first master volume 172 is in fluidic communication with the fluid connection 314. The second master volume 174 is in fluid communication with the first slave volume 176 via the fluid connection 170. The second slave volume 178 is in fluidic communication with fluid connection 324.

Similarly, the lower master cylinder 268 can comprise a first master volume 272 that is fluidically separated from a second master volume 274 by the lower master piston 264 and the lower master rod 265. The lower slave cylinder 269 can comprise a first slave volume 276 that is fluidically separated from a second slave volume 278 by the lower slave piston 266 and the lower slave rod 267. In the depicted embodiment, the first master volume 272 is in fluidic communication with the fluid connection 312. The second master volume 274 is in fluid communication with the first slave volume 276 via the fluid connection 270. The second slave volume 278 is in fluidic communication with fluid connection 322.

Accordingly, as pressurized fluid is supplied via fluid connection 310, the upper master cylinder 168 receives pressurized hydraulic fluid in the first master volume 172 and the lower master cylinder receives pressurized hydraulic fluid in the first master volume 272. As pressurized hydraulic fluid displaces the upper master piston 164, the upper master rod 165, which is coupled to the upper master piston 164, extends out of the upper master cylinder 168 and the hydraulic fluid is displaced from the second master volume 174 disposed on another side of the upper master piston 164. Contemporaneously, as pressurized hydraulic fluid displaces the lower master piston 264, the lower master rod 265, which is coupled to the lower master piston 264, extends out of the upper master cylinder 168 and hydraulic fluid is displaced from the second master volume 274 disposed on another side of the lower master piston 264.

As the hydraulic fluid is displaced from the second master volume 174 of the upper master cylinder 168, pressurized hydraulic fluid is received in the first slave volume 176 on a first side of the upper slave piston 166 which is coupled to the upper slave rod 167. As the amount of hydraulic fluid increases in the first slave volume 176, the upper slave piston 166 and the upper slave rod 167 are displaced. The motion of upper slave piston 166 and the upper slave rod 167 causes hydraulic fluid to be displaced out of the second slave volume 178 via the fluid connection 324. Similarly, as the hydraulic fluid is displaced from the second master volume 274 of the lower master cylinder 268, pressurized hydraulic fluid is received in the first slave volume 276 on a first side of the lower slave piston 266 which is coupled to the lower slave rod 267. As the amount of hydraulic fluid increases in the first slave volume 276, the lower slave piston 266 and the lower slave rod 267 are displaced. The motion of lower slave piston 266 and the lower slave rod 267 causes hydraulic fluid to be displaced out of the second slave volume 278 via the fluid connection 322.

It is noted that the rate displacement of the upper master rod 165 and the upper slave rod 167 can be made substantially equal by ensuring that volume of fluid displaced from the upper master cylinder 168 is substantially equal to the amount of fluid needed to the upper slave rod 167 a substantially equal distance. A similar relationship exists between the lower master rod 265 and the lower slave rod 267. Accordingly, the upper master rod 165 and the upper slave rod 167 can be displaced at substantially the same speed and travel substantially the same distance. Similarly, the lower master rod 265 and the lower slave rod 267 can be displaced at substantially the same speed and travel substantially the same distance.

Generally, the volume of the upper master cylinder 168, i.e., the sum of the first master volume 172 and the second master volume 174, is greater than the volume of the upper slave cylinder 169, i.e., the sum of the first slave volume 176 and the second slave volume 178. Similarly, the volume of the lower master cylinder 268, i.e., the sum of the first master volume 272 and the second master volume 274, is greater than the volume of the lower slave cylinder 269, i.e., the sum of the first slave volume 276 and the second slave volume 278. In one embodiment, the volume of the upper master cylinder 168 can be about double the volume of the upper slave cylinder 169. In another embodiment, the volume of the lower master cylinder 268 can be about double the volume of the lower slave cylinder 269. It is noted that the term "volume," as used herein, means a space enclosed by a cylinder that can be occupied by a fluid. Accordingly, pistons, rods, and other components should not be considered as part of a volume.

Referring again to FIG. 6, the master-slave hydraulic circuit 300 can include a flow divider to regulate the distribution of pressurized hydraulic fluid from pump motor 160 and substantially equally divide the flow between the upper master cylinder 168 and the lower master cylinder 268 to cause all of the rods 165, 167, 265, 267 to move in unison, i.e., the fluid can be divided equally to both master cylinders which causes the upper and lower rods to move at the same time. The direction of the displacement of the rods 165, 167, 265, 267 is controlled by pump motor 160, i.e., pressurized hydraulic fluid may be supplied fluid to the master cylinders for raising the corresponding legs by actuating the pump motor 160 in the first direction and pressurized hydraulic fluid may be supplied fluid to the slave cylinders for lowering the corresponding legs by actuating the pump motor 160 in the second direction.

Referring again to FIG. 7B, the upper master rod 165, the lower master rod 265, the upper slave rod 167 and the lower slave rod 267 are retracted in a manner that similar to the extension of the upper master rod 165, the lower master rod 265, the upper slave rod 167 and the lower slave rod 267, but with the direction of the pump motor 160 and the sequence reversed. Specifically, the pump motor 160 supplies pressurized hydraulic fluid via the fluid connection 320. As pressurized fluid is supplied via fluid connection 320, the upper slave cylinder 169 receives pressurized hydraulic fluid in the second slave volume 178 and the lower slave cylinder 269 receives pressurized hydraulic fluid in the second slave volume 278. As pressurized hydraulic fluid displaces the upper slave piston 166, the upper slave rod 167 retracts into the upper slave cylinder 169 and the hydraulic fluid is displaced from the first slave volume 176 disposed on the other side of the upper slave piston 166. Contemporaneously, as pressurized hydraulic fluid displaces the lower slave piston 266, the lower slave rod 267, retracts into the lower slave cylinder 269 and hydraulic fluid is displaced from the first slave volume 276 disposed on the other side of the lower slave piston 266.

As the hydraulic fluid is displaced from the first slave volume 176 of the upper slave piston 166, the pressurized hydraulic fluid is received in second master volume 174 of the upper master cylinder 168. As the amount of hydraulic fluid increases in second master volume 174, the upper master piston 164 and the upper master rod 165 are retracted. The motion of the upper master piston 164 and the upper master rod 165 causes hydraulic fluid to be displaced out of the first master volume 172 via the fluid connection 314. Similarly, as the hydraulic fluid is displaced from the first slave volume 276 of the lower slave piston 266, pressurized hydraulic fluid is received in the second master volume 274 of the lower master cylinder 268. As the amount of hydraulic fluid increases in the second master volume 274, the lower master piston 264 and the lower master rod 265 are retracted. The motion of lower master piston 264 and the lower master rod 265 causes hydraulic fluid to be displaced out of the first master volume 272 via the fluid connection 312.

According to the embodiments described herein, an inter-volume path 173 can be formed in the upper master piston 164, the upper master rod 165 or both to allow the communication of hydraulic fluid from the second master volume 174 to the first master volume 172 of the upper master cylinder 168. An inter-volume path 273 can be formed in the lower master piston 264, the lower master rod 265 or both to allow the communication of hydraulic fluid from the second master volume 274 to the first master volume 272 of the lower master cylinder 268. An inter-volume path 177 can be formed in the upper slave piston 166, the upper slave rod 167 or both to allow the communication of hydraulic fluid from the second slave volume 178 to the first slave volume 176 of the upper slave cylinder 169. An inter-volume path 277 can be formed in the lower slave piston 266, the lower slave rod 267 or both to allow the communication of hydraulic fluid from the second slave volume 278 to the first slave volume 276 of the lower slave cylinder 269.

Each of the inter-volume path 173, inter-volume path 273, inter-volume path 177 and inter-volume path 277 can be configured to operate when the upper master rod 165, the lower master rod 265, the upper slave rod 167 and the lower slave rod 267 are at a substantially fully retracted position. While not intended to be bound to theory, it is believed that allowing the communication of hydraulic fluid through the inter-volume paths can increase the reliability of the master-slave hydraulic circuit 300 by reducing the stagnation of air bubbles and air pockets within the cylinders of the master-slave hydraulic circuit 300 during retraction of the upper master rod 165, the lower master rod 265, the upper slave rod 167 and the lower slave rod 267. Specifically, it is believed that the communication of hydraulic fluid through the inter-volume paths can automatically "flush" the master-slave hydraulic circuit 300.

In one embodiment, each of the inter-volume path 173, inter-volume path 273, inter-volume path 177 and inter-volume path 277 can comprise an actuating one-way valve 194 that can be modulated between a closed position and a flow position. The actuating one-way valve 194 is normally in the closed position, i.e., unless modulated to the flow position, the actuating one-way valve 194 operates as a closed valve that blocks the flow of hydraulic fluid in any direction. When modulated to the flow position, actuating one-way valve 194 operates as a check valve that allows flow in one direction, but prevents flow in the opposite direction.

For example, an actuating one-way valve 194 can be oriented within the inter-volume path 173 to allow the communication of hydraulic fluid from the second master volume 174 to the first master volume 172 of the upper master cylinder 168, when the actuating one-way valve 194 is modulated to the flow position. An actuating one-way valve 194 can be oriented within the inter-volume path 273 to allow the communication of hydraulic fluid from the second master volume 274 to the first master volume 272 of the lower master cylinder 268, when the actuating one-way valve 194 is modulated to the flow position. An actuating one-way valve 194 can be oriented within the inter-volume path 177 to allow the communication of hydraulic fluid from the second slave volume 178 to the first slave volume 176 of the upper slave cylinder 169, when the actuating one-way valve 194 is modulated to the flow position. An actuating one-way valve 194 can be oriented within the inter-volume path 277 to allow the communication of hydraulic fluid from the second slave volume 278 to the first slave volume 276 of the lower slave cylinder 269, when the actuating one-way valve 194 is modulated to the flow position.

Referring collectively to FIGS. 6 and 7B, in one embodiment, an actuation member 190 can be disposed in each of the first master volume 172 of the upper master cylinder 168, the first master volume 272 of the lower master cylinder 268, the first slave volume 176 of the upper slave cylinder 169, and the first slave volume 176 of the lower slave cylinder 269. The actuation member 190 comprises a bias member 192 that is biased to resist retraction of an associated rod and a modulation member 191 that contacts the actuating one-way valve 194. The bias member 192 is configured to provide a force that is sufficient to displace a piston and rod when the pump motor 160 is not supplying pressurized fluid, and less than the force applied to the piston and rod when the pressurized fluid is supplied by the pump motor 160. The modulation member 191 of the actuation member 190 is configured to contact the actuating one-way valve 194, when the bias member 192 is compressed by the piston and rod as the pump motor 160 is retracting the piston and the rod. While the modulation member 191 contacts the actuating one-way valve 194, the actuating one-way valve 194 can be modulated to the flow position, as is described above.

For example, as the upper master piston 164 and the upper master rod 165 are retracted by the pump motor 160, the bias member 192 of the actuation member 190 can be compressed. After the bias member 192 is compressed, the modulation member 191 can be brought into contact with the actuating one-way valve 194 by the hydraulic fluid supplied by the pump motor 160. Accordingly, hydraulic fluid can flow from the second master volume 174 to the first master volume 172 of the upper master cylinder 168 under the urging of the pump motor 160. When the pump motor 160 ceases to actuate in the second direction (retracting), the bias member 192 separates the actuating one-way valve 194 from the modulation member 191, which causes the actuating one-way valve 194 to modulate to the closed position.

The actuating one-way valve 194 of each of the inter-volume path 273, inter-volume path 177 and inter-volume path 277 operates in a manner substantially equivalent to the actuating one-way valve 194 of the inter-volume path 173 described immediately above. Accordingly, the master-slave hydraulic circuit 300 can be periodically flushed by modulating the actuating one-way valves 194 during the retraction cycle. For example, the actuating one-way valve 194 of each of the inter-volume path 173, the inter-volume path 273, inter-volume path 177 and inter-volume path 277 can be modulated to a flow position each time the upper master rod 165, the lower master rod 265, the upper slave rod 167 and the lower slave rod 267 are retracted.

Referring again to FIGS. 1 and 2, to determine whether the roll-in cot 10 is level, sensors (not depicted) may be utilized to measure distance and/or angle. For example, the front actuator 16 and the back actuator 18 may each comprise encoders which determine the length of each actuator. In one embodiment, the encoders are real time encoders which are operable to detect movement of the total length of the actuator or the change in length of the actuator when the cot is powered or unpowered (i.e., manual control). While various encoders are contemplated, the encoder, in one commercial embodiment, may be the optical encoders produced by Midwest Motion Products, Inc. of Watertown, Minn. U.S.A. In other embodiments, the cot comprises angular sensors that measure actual angle or change in angle such as, for example, potentiometer rotary sensors, hall effect rotary sensors and the like. The angular sensors can be operable to detect the angles of any of the pivotingly coupled portions of the front legs 20 and/or the back legs 40. In one embodiment, angular sensors are operably coupled to the front legs 20 and the back legs 40 to detect the difference between the angle of the front leg 20 and the angle of the back leg 40 (angle delta). A loading state angle may be set to an angle such as about 20° or any other angle that generally indicates that the roll-in cot 10 is in a loading state (indicative of loading and/or unloading). Thus, when the angle delta exceeds the loading state angle the roll-in cot 10 may detect that it is in a loading state and perform certain actions dependent upon being in the loading state.

In the embodiments described herein, the control box 50 comprises or is operably coupled to a processor and a memory. The processor may be an integrated circuit, a microchip, a computer, or any other computing device capable of executing machine readable instructions. The electronic memory may be RAM, ROM, a flash memory, a hard drive, or any device capable of storing machine readable instructions. Additionally, it is noted that distance sensors may be coupled to any portion of the roll-in cot 10 such that the distance between a lower surface and components such as, for example, the front end 17, the back end 19, the front load wheels 70, the front wheels 26, the intermediate load wheels 30, the back wheels 46, the front actuator 16 or the back actuator 18 may be determined.

It is noted that the term "sensor," as used herein, means a device that measures a physical quantity and converts it into a signal which is correlated to the measured value of the physical quantity. Furthermore, the term "signal" means an electrical, magnetic or optical waveform, such as current, voltage, flux, DC, AC, sinusoidal-wave, triangular-wave, square-wave, and the like, capable of being transmitted from one location to another.

Referring collectively to FIGS. 2 and 4A-E, the front end 17 may also comprise a pair of front load wheels 70 configured to assist in loading the roll-in cot 10 onto a loading surface 500 (e.g., the floor of an ambulance). The roll-in cot 10 may comprise sensors operable to detect the location of the front load wheels 70 with respect to a loading surface 500 (e.g., distance above the surface or contact with the surface). In one or more embodiments, the front load wheel sensors comprise touch sensors, proximity sensors, or other suitable sensors effective to detect when the front load wheels 70 are above a loading surface 500. In one embodiment, the front load wheel sensors are ultrasonic sensors aligned to detect directly or indirectly the distance from the front load wheels to a surface beneath the load wheels. Specifically, the ultrasonic sensors, described herein, may be operable to provide an indication when a surface is within a definable range of distance from the ultrasonic sensor (e.g., when a surface is greater than a first distance but less than a second distance). Thus, the definable range may be set such that a positive indication is provided by the sensor when a portion of the roll-in cot 10 is in proximity to a loading surface 500.

In a further embodiment, multiple front load wheel sensors may be in series, such that the front load wheel sensors are activated only when both front load wheels 70 are within a definable range of the loading surface 500 (i.e., distance may be set to indicate that the front load wheels 70 are in contact with a surface). As used in this context, "activated" means that the front load wheel sensors send a signal to the control box 50 that the front load wheels 70 are both above the loading surface 500. Ensuring that both front load wheels 70 are on the loading surface 500 may be important, especially in circumstances when the roll-in cot 10 is loaded into an ambulance at an incline.

The front legs 20 may comprise intermediate load wheels 30 attached to the front legs 20. In one embodiment, the intermediate load wheels 30 may be disposed on the front legs 20 adjacent the front cross beam 22. Like the front load wheels 70, the intermediate load wheels 30 may comprise a sensor (not shown) which are operable to measure the distance the intermediate load wheels 30 are from a loading surface 500. The sensor may be a touch sensor, a proximity sensor, or any other suitable sensor operable to detect when the intermediate load wheels 30 are above a loading surface 500. As is explained in greater detail herein, the load wheel sensor may detect that the wheels are over the floor of the vehicle, thereby allowing the back legs 40 to safely retract. In some additional embodiments, the intermediate load wheel sensors may be in series, like the front load wheel sensors, such that both intermediate load wheels 30 must be above the loading surface 500 before the sensors indicate that the load wheels are above the loading surface 500 i.e., send a signal to the control box 50. In one embodiment, when the intermediate load wheels 30 are within a set distance of the loading surface the intermediate load wheel sensor may provide a signal which causes the control box 50 to activate the back actuator 18. Although the figures depict the intermediate load wheels 30 only on the front legs 20, it is further contemplated that intermediate load wheels 30 may also be disposed on the back legs 40 or any other position on the roll-in cot 10 such that the intermediate load wheels 30 cooperate with the front load wheels 70 to facilitate loading and/or unloading (e.g., the support frame 12).

Referring again to FIG. 2, the roll-in cot 10 may comprise a front actuator sensor 62 and a back actuator sensor 64 configured to detect whether the front and back actuators 16, 18 respectively are under tension or compression. As used herein, the term "tension" means that a pulling force is being detected by the sensor. Such a pulling force is commonly associated with the load being removed from the legs coupled to the actuator, i.e., the leg and or wheels are being suspended from the support frame 12 without making contact with a surface beneath the support frame 12. Furthermore, as used herein the term "compression" means that a pushing force is being detected by the sensor. Such a pushing force is commonly associated with a load being applied to the legs coupled to the actuator, i.e., the leg and or wheels are in contact with a surface beneath the support frame 12 and transfer a compressive strain on the coupled actuator. In one embodiment, the front actuator sensor 62 and the back actuator sensor 64 are coupled to the support frame 12; however, other locations or configurations are contemplated herein. The sensors may be proximity sensors, strain gauges, load cells, hall-effect sensors, or any other suitable sensor operable to detect when the front actuator 16 and/or back actuator 18 are under tension or compression. In further embodiments, the front actuator sensor 62 and the back actuator sensor 64 may be operable to detect the weight of a patient disposed on the roll-in cot 10 (e.g., when strain gauges are utilized).

Referring again to the embodiment of FIG. 1, the back end 19 may comprise operator controls for the roll-in cot 10. As used herein, the operator controls are the components used by the operator in the loading and unloading of the roll-in cot 10 by controlling the movement of the front legs 20, the back legs 40, and the support frame 12. Referring to FIG. 2, the operator controls may comprise one or more hand controls 57 (for example, buttons on telescoping handles) disposed on the back end 19 of the roll-in cot 10. Moreover, the operator controls may include a control box 50 disposed on the back end 19 of the roll-in cot 10, which is used by the cot to switch from the default independent mode and the synchronized or "sync" mode. The control box 50 may comprise one or more buttons 54, 56 which place in the cot in sync mode, such that both the front legs 20 and back legs 40 can be raised and lowered simultaneously. In a specific embodiment, the sync mode may only be temporary and cot operation will return to the default mode after a period of time, for example, about 30 seconds. In a further embodiment, the sync mode may be utilized in loading and/or unloading the roll-in cot 10. While various positions are contemplated, the control box may be disposed between the handles on the back end 19.

As an alternative to the hand control embodiment, the control box 50 may also include a component which may be used to raise and lower the roll-in cot 10. In one embodiment, the component is a toggle switch 52, which is able to raise (+) or lower (−) the cot. Other buttons, switches, or knobs are also suitable. Due to the integration of the sensors in the roll-in cot 10, as is explained in greater detail herein, the toggle switch 52 may be used to control the front legs 20 or back legs 40 which are operable to be raised, lowered, retracted or released depending on the position of the roll-in cot 10. In one embodiment the toggle switch is analog (i.e., the pressure and/or displacement of the analog switch is proportional to the speed of actuation). The operator controls may comprise a visual display component 58 configured to inform an operator whether the front and back actuators 16, 18 are activated or deactivated, and thereby may be raised, lowered, retracted or released. While the operator controls are disposed at the back end 19 of the roll-in cot 10 in the present embodiments, it is further contemplated that the operator controls be positioned at alternative positions on the support frame 12, for example, on the front end 17 or the sides of the support frame 12. In still further embodiments, the operator controls may be located in a removably attachable wireless remote control that may control the roll-in cot 10 without physical attachment to the roll-in cot 10.

Turning now to embodiments of the roll-in cot 10 being simultaneously actuated, the cot of FIG. 2 is depicted as extended, thus front actuator sensor 62 and back actuator sensor 64 detect that the front actuator 16 and the back actuator 18 are under compression, i.e., the front legs 20 and the back legs 40 are in contact with a lower surface and are loaded. The front and back actuators 16 and 18 are both active when the front and back actuator sensors 62, 64 detect both the front and back actuators 16, 18, respectively, are under compression and can be raised or lowered by the operator using the operator controls (e.g., "−" to lower and "+" to raise).

Figure 3A:
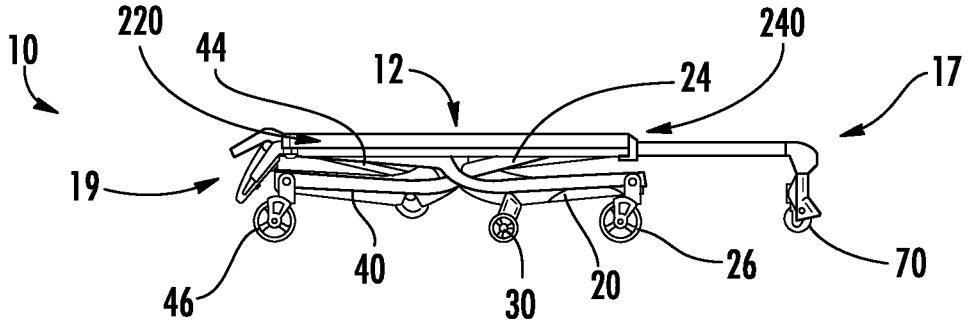
FIGS. 3A-3C is a side view depicting a raising and/or lower sequence of a cot according to one or more embodiments described herein.
Figure 3B:
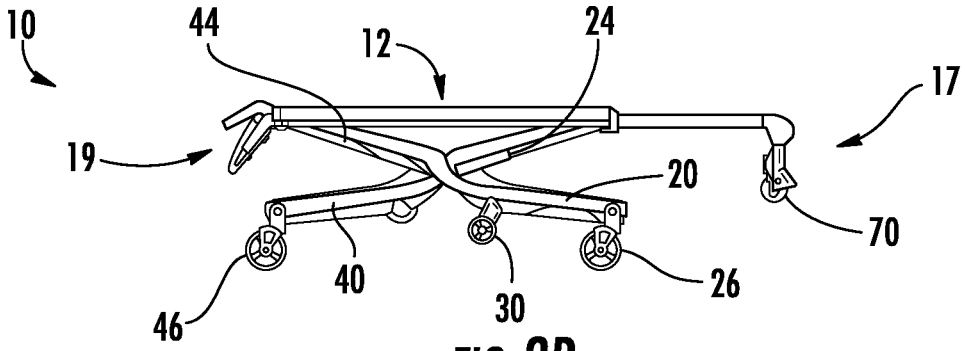
Figure 3C:
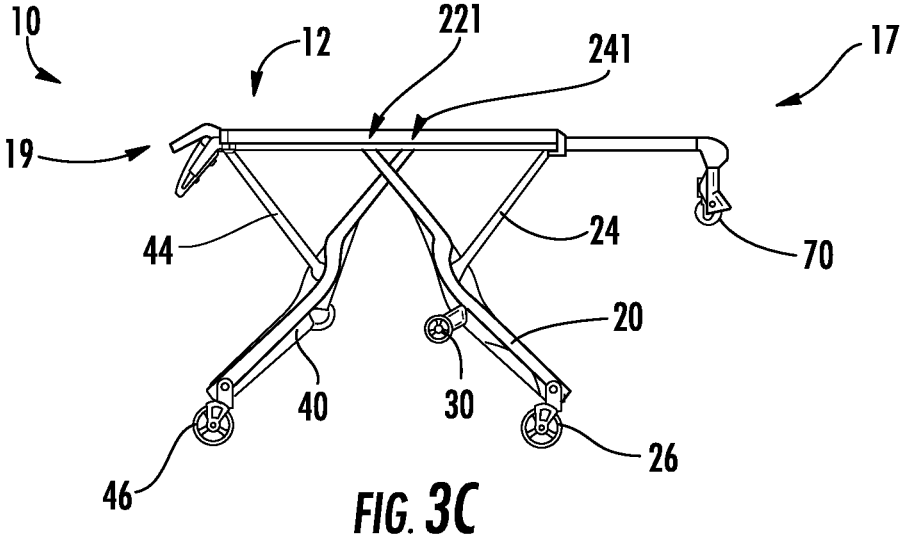

Referring collectively to FIGS. 3A-3C, an embodiment of the roll-in cot 10 being raised (FIGS. 3A-3C) or lowered (FIGS. 3C-3A) via simultaneous actuation is schematically depicted (note that for clarity the front actuator 16 and the back actuator 18 are not depicted in FIGS. 3A-3C). In the depicted embodiment, the roll-in cot 10 comprises a support frame 12 slidingly engaged with a pair of front legs 20 and a pair of back legs 40. Each of the front legs 20 are rotatably coupled to a front hinge member 24 that is rotatably coupled to the support frame 12. Each of the back legs 40 are rotatably coupled to a back hinge member 44 that is rotatably coupled to the support frame 12. In the depicted embodiment, the front hinge members 24 are rotatably coupled towards the front end 17 of the support frame 12 and the back hinge members 44 that are rotatably coupled to the support frame 12 towards the back end 19.

FIG. 3A depicts the roll-in cot 10 in a lowest transport position, which corresponds to the master-slave hydraulic circuit 300 depicted in FIG. 7B. Specifically, the back wheels 46 and the front wheels 26 are in contact with a surface, the front leg 20 is slidingly engaged with the support frame 12 such that the front leg 20 contacts a portion of the support frame 12 towards the back end 19 and the back leg 40 is slidingly engaged with the support frame 12 such that the back leg 40 contacts a portion of the support frame 12 towards the front end 17. FIG. 3B depicts the roll-in cot 10 in an intermediate transport position, i.e., the front legs 20 and the back legs 40 are in intermediate transport positions along the support frame 12, which corresponds to the master-slave hydraulic circuit 300 depicted in FIG. 7A. FIG. 3C depicts the roll-in cot 10 in a highest transport position, i.e., the front legs 20 and the back legs 40 positioned along the support frame 12 such that the front load wheels 70 are at a maximum desired height which can be set to height sufficient to load the cot, as is described in greater detail herein.

The embodiments described herein may be utilized to lift a patient from a position below a vehicle in preparation for loading a patient into the vehicle (e.g., from the ground to above a loading surface of an ambulance). Specifically, the roll-in cot 10 may be raised from the lowest transport position (FIG. 3A) to an intermediate transport position (FIG. 3B) or the highest transport position (FIG. 3C) by simultaneously actuating the front legs 20 and back legs 40 and causing them to slide along the support frame 12. When being raised, the actuation causes the front legs to slide towards the front end 17 and to rotate about the front hinge members 24, and the back legs 40 to slide towards the back end 19 and to rotate about the back hinge members 44. Specifically, a user may interact with a control box 50 (FIG. 2) and provide input indicative of a desire to raise the roll-in cot 10 (e.g., by pressing "+" on toggle switch 52). The roll-in cot 10 is raised from its current position (e.g., lowest transport position or an intermediate transport position) until it reaches the highest transport position. Upon reaching the highest transport position, the actuation may cease automatically, i.e., to raise the roll-in cot 10 higher additional input is required. Input may be provided to the roll-in cot 10 and/or control box 50 in any manner such as electronically, audibly or manually.

The roll-in cot 10 may be lowered from an intermediate transport position (FIG. 3B) or the highest transport position (FIG. 3C) to the lowest transport position (FIG. 3A) by simultaneously actuating the front legs 20 and back legs 40 and causing them to slide along the support frame 12. Specifically, when being lowered, the actuation causes the front legs to slide towards the back end 19 and to rotate about the front hinge members 24, and the back legs 40 to slide towards the front end 17 and to rotate about the back hinge members 44. For example, a user may provide input indicative of a desire to lower the roll-in cot 10 (e.g., by pressing a "−" on toggle switch 52). Upon receiving the input, the roll-in cot 10 lowers from its current position (e.g., highest transport position or an intermediate transport position) until it reaches the lowest transport position. Once the roll-in cot 10 reaches its lowest height (e.g., the lowest transport position) the actuation may cease automatically. In some embodiments, the control box 50 (FIG. 1) provides a visual indication that the front legs 20 and back legs 40 are active during movement.

In one embodiment, when the roll-in cot 10 is in the highest transport position (FIG. 3C), the front legs 20 are in contact with the support frame 12 at a front-loading index 221 and the back legs 40 are in contact with the support frame 12 a back-loading index 241. While the front-loading index 221 and the back-loading index 241 are depicted in FIG. 3C as being located near the middle of the support frame 12, additional embodiments are contemplated with the front-loading index 221 and the back-loading index 241 located at any position along the support frame 12. For example, the highest transport position may be set by actuating the roll-in cot 10 to the desired height and providing input indicative of a desire to set the highest transport position (e.g., pressing and holding the "+" and "−" on toggle switch 52 simultaneously for 10 seconds).

In another embodiment, any time the roll-in cot 10 is raised over the highest transport position for a set period of time (e.g., 30 seconds), the control box 50 provides an indication that the roll-in cot 10 has exceeded the highest transport position and the roll-in cot 10 needs to be lowered. The indication may be visual, audible, electronic or combinations thereof.

When the roll-in cot 10 is in the lowest transport position (FIG. 3A), the front legs 20 may be in contact with the support frame 12 at a front-flat index 220 located near the back end 19 of the support frame 12 and the back legs 40 may be in contact with the support frame 12 a back-flat index 240 located near the front end 17 of the support frame 12. Furthermore, it is noted that the term "index," as used herein means a position along the support frame 12 that corresponds to a mechanical stop or an electrical stop such as, for example, an obstruction in a channel formed in a lateral side member 15, a locking mechanism, or a stop controlled by a servomechanism.

The front actuator 16 is operable to raise or lower a front end 17 of the support frame 12 independently of the back actuator 18. The back actuator 18 is operable to raise or lower a back end 19 of the support frame 12 independently of the front actuator 16. By raising the front end 17 or back end 19 independently, the roll-in cot 10 is able to maintain the support frame 12 level or substantially level when the roll-in cot 10 is moved over uneven surfaces, for example, a staircase or hill. Specifically, if one of the front legs 20 or the back legs 40 is in tension, the set of legs not in contact with a surface (i.e., the set of legs that is in tension) is activated by the roll-in cot 10 (e.g., moving the roll-in cot 10 off of a curb). Further embodiments of the roll-in cot 10 are operable to be automatically leveled. For example, if back end 19 is lower than the front end 17, pressing the "+" on toggle switch 52 raises the back end 19 to level prior to raising the roll-in cot 10, and pressing the "−" on toggle switch 52 lowers the front end 17 to level prior to lowering the roll-in cot 10.

In one embodiment, depicted in FIG. 2, the roll-in cot 10 receives a first load signal from the front actuator sensor 62 indicative of a first force acting upon the front actuator 16 and a second load signal from the front actuator sensor 62 indicative of a second force acting upon a back actuator 18. The first load signal and second load signal may be processed by logic executed by the control box 50 to determine the response of the roll-in cot 10 to input received by the roll-in cot 10. Specifically, user input may be entered into the control box 50. The user input is received as control signal indicative of a command to change a height of the roll-in cot 10 by the control box 50. Generally, when the first load signal is indicative of tension and the second load signal is indicative of compression, the front actuator actuates the front legs 20 and the back actuator 18 remains substantially static (e.g., is not actuated). Therefore, when only the first load signal indicates a tensile state, the front legs 20 may be raised by pressing the "−" on toggle switch 52 and/or lowered by pressing the "+" on toggle switch 52. Generally, when the second load signal is indicative of tension and the first load signal is indicative of compression, the back actuator 18 actuates the back legs 40 and the front actuator 16 remains substantially static (e.g., is not actuated). Therefore, when only the second load signal indicates a tensile state, the back legs 40 may be raised by pressing the "−" on toggle switch 52 and/or lowered by pressing the "+" on toggle switch 52. In some embodiments, the actuators may actuate relatively slowly upon initial movement (i.e., slow start) to mitigate rapid jostling of the support frame 12 prior to actuating relatively quickly.

Referring collectively to FIGS. 3C-4E, independent actuation may be utilized by the embodiments described herein for loading a patient into a vehicle (note that for clarity the front actuator 16 and the back actuator 18 are not depicted in FIGS. 3C-4E). Specifically, the roll-in cot 10 can be loaded onto a loading surface 500 according the process described below. First, the roll-in cot 10 may be placed into the highest transport position (FIG. 3C) or any position where the front load wheels 70 are located at a height greater than the loading surface 500. When the roll-in cot 10 is loaded onto a loading surface 500, the roll-in cot 10 may be raised via front and back actuators 16 and 18 to ensure the front load wheels 70 are disposed over a loading surface 500. Then, the roll-in cot 10 may be lowered until front load wheels 70 contact the loading surface 500 (FIG. 4A).

Figure 4A:
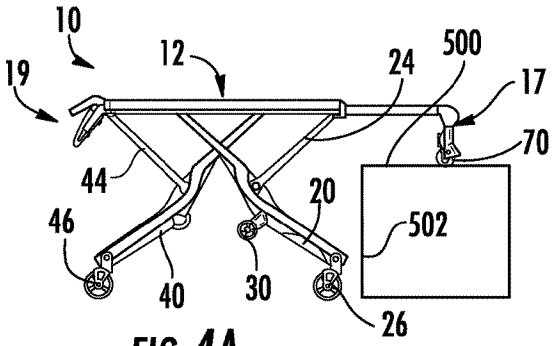
FIGS. 4A-4E is a side view depicting a loading and/or unloading sequence of a cot according to one or more embodiments described herein.
Figure 4B:
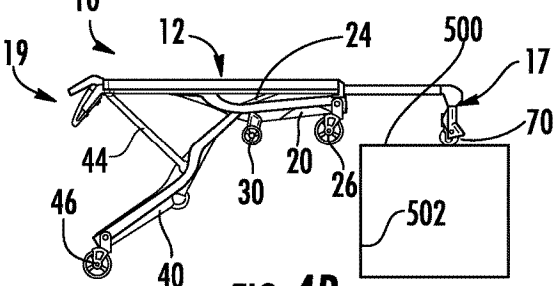

As is depicted in FIG. 4A, the front load wheels 70 are over the loading surface 500. In one embodiment, after the load wheels contact the loading surface 500 the pair of front legs 20 can be actuated with the front actuator 16 because the front end 17 is above the loading surface 500. As depicted in FIGS. 4A and 4B, the middle portion of the roll-in cot 10 is away from the loading surface 500 (i.e., a large enough portion of the roll-in cot 10 has not been loaded beyond the loading edge 502 such that most of the weight of the roll-in cot 10 can be cantilevered and supported by the wheels 70, 26, and/or 30). When the front load wheels are sufficiently loaded, the roll-in cot 10 may be held level with a reduced amount of force. Additionally, in such a position, the front actuator 16 is in tension and the back actuator 18 is in compression. Thus, for example, if the "−" on toggle switch 52 is activated, the front legs 20 are raised (FIG. 4B). In one embodiment, after the front legs 20 have been raised enough to trigger a loading state, the operation of the front actuator 16 and the back actuator 18 is dependent upon the location of the roll-in cot. In some embodiments, upon the front legs 20 raising, a visual indication is provided on the visual display component 58 of the control box 50 (FIG. 2). The visual indication may be color-coded (e.g., activated legs in green and non-activated legs in red). This front actuator 16 may automatically cease to operate when the front legs 20 have been fully retracted. Furthermore, it is noted that during the retraction of the front legs 20, the front actuator sensor 62 may detect tension, at which point, front actuator 16 may raise the front legs 20 at a higher rate, for example, fully retract within about 2 seconds.

Figure 4C:
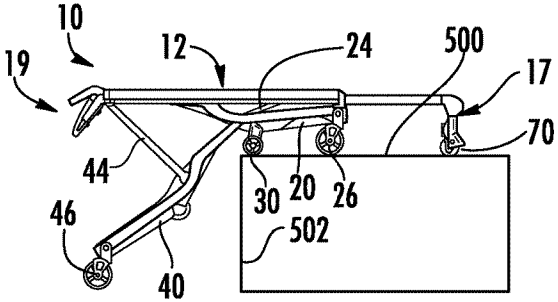

After the front legs 20 have been retracted, the roll-in cot 10 may be urged forward until the intermediate load wheels 30 have been loaded onto the loading surface 500 (FIG. 4C). As depicted in FIG. 4C, the front end 17 and the middle portion of the roll-in cot 10 are above the loading surface 500. As a result, the pair of back legs 40 can be retracted with the back actuator 18. Specifically, an ultrasonic sensor may be positioned to detect when the middle portion is above the loading surface 500. When the middle portion is above the loading surface 500 during a loading state (e.g., the front legs 20 and back legs 40 have an angle delta greater than the loading state angle), the back actuator may be actuated. In one embodiment, an indication may be provided by the control box 50 (FIG. 2) when the intermediate load wheels 30 are sufficiently beyond the loading edge 502 to allow for back leg 40 actuation (e.g., an audible beep may be provided).

It is noted that, the middle portion of the roll-in cot 10 is above the loading surface 500 when any portion of the roll-in cot 10 that may act as a fulcrum is sufficiently beyond the loading edge 502 such that the back legs 40 may be retracted a reduced amount of force is required to lift the back end 19 (e.g., less than half of the weight of the roll-in cot 10, which may be loaded, needs to be supported at the back end 19). Furthermore, it is noted that the detection of the location of the roll-in cot 10 may be accomplished by sensors located on the roll-in cot 10 and/or sensors on or adjacent to the loading surface 500. For example, an ambulance may have sensors that detect the positioning of the roll-in cot 10 with respect to the loading surface 500 and/or loading edge 502 and communications means to transmit the information to the roll-in cot 10.

Figure 4D:
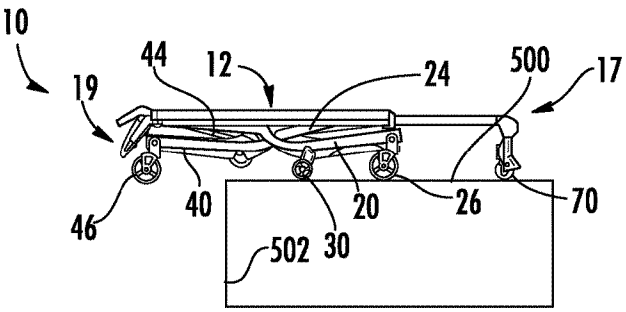

Referring to FIG. 4D, after the back legs 40 are retracted and the roll-in cot 10 may be urged forward. In one embodiment, during the back leg retraction, the back actuator sensor 64 may detect that the back legs 40 are unloaded, at which point, the back actuator 18 may raise the back legs 40 at higher speed. Upon the back legs 40 being fully retracted, the back actuator 18 may automatically cease to operate. In one embodiment, an indication may be provided by the control box 50 (FIG. 2) when the roll-in cot 10 is sufficiently beyond the loading edge 502 (e.g., fully loaded or loaded such that the back actuator is beyond the loading edge 502).

Once the cot is loaded onto the loading surface (FIG. 4E), the front and back actuators 16, 18 may be deactivated by being lockingly coupled to an ambulance. The ambulance and the roll-in cot 10 may each be fitted with components suitable for coupling, for example, male-female connectors. Additionally, the roll-in cot 10 may comprise a sensor which registers when the cot is fully disposed in the ambulance, and sends a signal which results in the locking of the actuators 16, 18. In yet another embodiment, the roll-in cot 10 may be connected to a cot fastener, which locks the actuators 16, 18, and is further coupled to the ambulance's power system, which charges the roll-in cot 10. A commercial example of such ambulance charging systems is the Integrated Charging System (ICS) produced by Ferno-Washington, Inc.

Figure 4E:
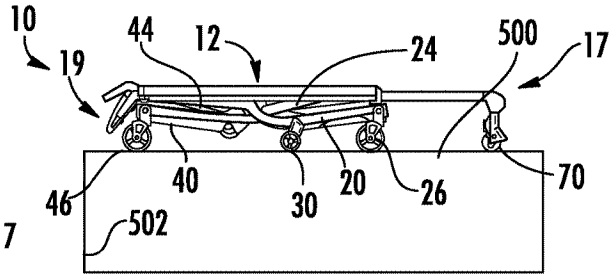

Referring collectively to FIGS. 4A-4E, independent actuation, as is described above, may be utilized by the embodiments described herein for unloading the roll-in cot 10 from a loading surface 500. Specifically, the roll-in cot 10 may be unlocked from the fastener and urged towards the loading edge 502 (FIG. 4E to FIG. 4D). As the back wheels 46 are released from the loading surface 500 (FIG. 4D), the back actuator sensor 64 detects that the back legs 40 are unloaded and allows the back legs 40 to be lowered. In some embodiments, the back legs 40 may be prevented from lowering, for example if sensors detect that the cot is not in the correct location (e.g., the back wheels 46 are above the loading surface 500 or the intermediate load wheels 30 are away from the loading edge 502). In one embodiment, an indication may be provided by the control box 50 (FIG. 2) when the back actuator 18 is activated (e.g., the intermediate load wheels 30 are near the loading edge 502 and/or the back actuator sensor 64 detects tension).

When the roll-in cot 10 is properly positioned with respect to the loading edge 502, the back legs 40 can be extended (FIG. 4C). For example, the back legs 40 may be extended by pressing the "+" on toggle switch 52. In one embodiment, upon the back legs 40 lowering, a visual indication is provided on the visual display component 58 of the control box 50 (FIG. 2). For example, a visual indication may be provided when the roll-in cot 10 is in a loading state and the back legs 40 and/or front legs 20 are actuated. Such a visual indication may signal that the roll-in cot should not be moved (e.g., pulled, pushed, or rolled) during the actuation. When the back legs 40 contact the floor (FIG. 4C), the back legs 40 become loaded and the back actuator sensor 64 deactivates the back actuator 18.

When a sensor detects that the front legs 20 are clear of the loading surface 500 (FIG. 4B), the front actuator 16 is activated. In one embodiment, when the intermediate load wheels 30 are at the loading edge 502 an indication may be provided by the control box 50 (FIG. 2). The front legs 20 are extended until the front legs 20 contact the floor (FIG. 4A). For example, the front legs 20 may be extended by pressing the "+" on toggle switch 52. In one embodiment, upon the front legs 20 lowering, a visual indication is provided on the visual display component 58 of the control box 50 (FIG. 2).

It should now be understood that the embodiments described herein may be utilized to transport patients of various sizes by coupling a support surface such as a patient support surface to the support frame. For example, a lift-off stretcher or an incubator may be removably coupled to the support frame. Therefore, the embodiments described herein may be utilized to load and transport patients ranging from infants to bariatric patients. Furthermore the embodiments described herein, may be loaded onto and/or unloaded from an ambulance by an operator holding a single button to actuate the independently articulating legs (e.g., pressing the "−" on the toggle switch to load the cot onto an ambulance or pressing the "+" on the toggle switch to unload the cot from an ambulance). Specifically, the roll-in cot 10 may receive an input signal such as from the operator controls. The input signal may be indicative a first direction or a second direction (lower or raise). The pair of front legs and the pair of back legs may be lowered independently when the signal is indicative of the first direction or may be raised independently when the signal is indicative of the second direction.

It is further noted that terms like "preferably," "generally," "commonly," and "typically" are not utilized herein to limit the scope of the claimed embodiments or to imply that certain features are critical, essential, or even important to the structure or function of the claimed embodiments. Rather, these terms are merely intended to highlight alternative or additional features that may or may not be utilized in a particular embodiment of the present disclosure.

For the purposes of describing and defining the present disclosure it is additionally noted that the term "substantially" is utilized herein to represent the inherent degree of uncertainty that may be attributed to any quantitative comparison, value, measurement, or other representation. The term "substantially" is also utilized herein to represent the degree by which a quantitative representation may vary from a stated reference without resulting in a change in the basic function of the subject matter at issue.

Having provided reference to specific embodiments, it will be apparent that modifications and variations are possible without departing from the scope of the present disclosure defined in the appended claims. More specifically, although some aspects of the present disclosure are identified herein as preferred or particularly advantageous, it is contemplated that the present disclosure is not necessarily limited to these preferred aspects of any specific embodiment.

The invention claimed is:

1. A cot comprising:

a support frame;

front and back legs each pivotally and slidably coupled to the support frame independently from one another;

a cot actuation system having front and back hydraulic actuators each respectively coupled to and configured to raise or lower the front and back legs; and a manual release system coupled to the cot actuation system through a manual release valve and a fluid reservoir, the manual release system comprising a manual actuation component coupled to at least one of the front and back hydraulic actuators through a spring-biased linkage such that upon user-initiated actuation of the manual actuation component, the linkage opens the manual release valve to deliver hydraulic fluid from the at least one of the front and back hydraulic actuators to the fluid reservoir in order to manually lower the cot at a controlled descent rate.

2. The cot of claim 1 wherein the linkage comprises a cable between the manual actuation component and the manual release valve.

3. The cot of claim 2 wherein the linkage further comprises a rotating cam member attached to and movable with the cable.

4. The cot of claim 3 wherein the linkage further comprises a lever disposed between the manual release valve and the rotating cam member, wherein movement of the rotating cam member drives the lever which thereby opens the manual release valve.

5. The cot of claim 3 wherein the linkage further comprises a return spring configured to reset the position of the rotating cam member.

6. The cot of claim 1 further comprising a return spring which resets the manual release valve into a closed position when the manual actuation component is not being held by a user.

7. The cot of claim 1 wherein the manual actuation component comprises a handle, knob, or button.

8. The cot of claim 1 wherein the manual actuation component is a bicycle handlebar.

9. The cot of claim 1 wherein the manual release valve is spring biased.

10. The cot of claim 1 wherein the manual release system further comprises a flow regulator configured to control a flow rate of the hydraulic fluid into the fluid reservoir.

11. The cot of claim 10 wherein a release of hydraulic fluid into the fluid reservoir at the controlled flow rate is configured to manually lower the cot at the controlled descent rate.

12. The cot of claim 10 wherein the flow regulator is triggered by application of a load force on the support frame, the flow regulator being configured to control the flow rate of the hydraulic fluid from the at least one hydraulic actuator such that the at least one hydraulic actuator at least partially counters the load force and thereby facilitates the controlled descent of the cot.

13. The cot of claim 1 wherein the cot actuation system comprises a front hydraulic actuator configured to raise or lower the front legs, and a back hydraulic actuator configured to raise or lower the back legs.

14. The cot of claim 13 further comprising a motor configured to control both the front actuator and the back actuator.

15. The cot of claim 14 further comprising a pump in communication with the motor, the front actuator, and the back actuator.

16. The cot of claim 13 further comprising an individual motor for the front actuator and an individual motor for the back actuator.

* * * * *